US007028348B2

(12) United States Patent
Tadaka et al.

(10) Patent No.: US 7,028,348 B2
(45) Date of Patent: Apr. 18, 2006

(54) HAIR DRESSING DEVICE EQUIPPED WITH HOOD

(75) Inventors: Tomoaki Tadaka, Osaka (JP); Keiji Ito, Osaka (JP); Norimasa Okuzaki, Osaka (JP); Hajime Mizutani, Osaka (JP)

(73) Assignee: Takara Belmont Corporation, Osaka (JP)

( * ) Notice: Subject to any disclaimer, the term of this patent is extended or adjusted under 35 U.S.C. 154(b) by 0 days.

(21) Appl. No.: 10/390,025

(22) Filed: Mar. 18, 2003

(65) Prior Publication Data

US 2003/0177571 A1 Sep. 25, 2003

(30) Foreign Application Priority Data

| | | |
|---|---|---|
| Mar. 22, 2002 | (JP) | 2002-080977 |
| Mar. 22, 2002 | (JP) | 2002-080980 |
| Aug. 30, 2002 | (JP) | 2002-254674 |
| Aug. 30, 2002 | (JP) | 2002-254675 |
| Aug. 30, 2002 | (JP) | 2002-254676 |

(51) Int. Cl.
*A45D 19/00* (2006.01)

(52) U.S. Cl. ..... 4/516; 4/518; 132/272

(58) Field of Classification Search ..... 4/515, 4/516, 517, 518, 519, 520, 522, 537, 521; 132/271, 272

See application file for complete search history.

(56) References Cited

U.S. PATENT DOCUMENTS

| | | | | |
|---|---|---|---|---|
| 1,223,263 | A * | 4/1917 | Day | 4/520 |
| 3,343,530 | A * | 9/1967 | Solos et al. | 4/518 X |
| 3,521,647 | A * | 7/1970 | Mercer | 132/272 |
| 3,814,111 | A * | 6/1974 | Doyle et al. | 132/272 |
| 3,934,596 | A * | 1/1976 | Suntheimer et al. | 132/272 |
| 4,377,174 | A * | 3/1983 | Muraji et al. | 132/272 X |
| 4,834,121 | A * | 5/1989 | Bell | 132/272 |
| 4,841,584 | A * | 6/1989 | Overcash et al. | 4/519 |
| 6,024,100 | A * | 2/2000 | Fukuyama | 132/272 X |

* cited by examiner

*Primary Examiner*—Robert M. Fetsuga
(74) *Attorney, Agent, or Firm*—McDermott Will & Emery LLP

(57) ABSTRACT

In order to dress a subject's hair using the two first and second kinds of medicine solutions, a hood must be once taken off. Therefore, in order to apply the second medicine solution, the position of the hood must be adjusted so that the head is centrally located at the hood. This adjustment is troublesome for both the operator and subject. In order to obviate such inconvenience, a hair dressing device equipped with a hood D includes a fixed hood 71 and an opening/closing hood 72 into which said hood is divided, said opening/closing hood being openably attached to said fixed hood. In this case, said opening/closing hood 72 is opened/closed so that said fixed hood 71 is opened from above.

9 Claims, 19 Drawing Sheets

HAIR DRESSING DEVICE EQUIPPED WITH HOOD

BACKGROUND OF THE INVENTION

1. Field of the Invention

This invention relates to a hair dressing device equipped with hood, and more particularly a hair treatment device in which an operator can treat a subject's head from above, or which can shorten the time required for treatment, and a drain tank used in the hair treatment device.

2. Description of the Related Art

In a conventional hair dressing device, where two kinds of medicine solutions are used for the operation such as treatment, the operation was performed as follows. After a first medicine solution has been applied to a subject's hair, a hood is put on the subject's head to treat the hair. After a prescribed time elapses, the hood is taken off from the head. Further, a second medicine solution is applied to the subject's hair and the hood is put on the subject's head again. Where the operator makes the operation from just behind the subject, the operator shifts the hair dressing device sideways.

Meanwhile, in order to treat the hair using the two kinds of medicine solutions in the above operation process, the hood must be once taken off. Therefore, in order to apply the second medicine solution, the position of the hood must be adjusted so that the head is centrally located at the hood. This adjustment is troublesome for both the operator and subject.

Where the operator treats the subject's hair from just behind, the hair dressing device must be moved. This is troublesome. In addition, when the hair treatment device is moved, as the case may be, the device falls down and is damaged.

This invention intends to solve the above problem, and hence a first object of this invention is to provide a hair dressing device which can improve the operability by carrying out an operation with the upper surface of a hood being opened when the solution to be applied is exchanged from a first solution into a second solution, and is not troublesome in the operation and can prevent damage owing to fall-down by carrying out the operation from real behind a subject without moving the device.

Further, in the conventional hair dressing device equipped with a hood, treatment for the hair is carried out in the following manner. After a first medicine solution for treatment has been applied to the hair, with a subject's head being covered with a hood, water vapor is supplied into the hood to promote the hair. Upon completion of hair promotion, the supply of the water vapor is stopped. Thereafter, with the head being covered with the hood, the natural cooling of the hair is done. After the hair has been cooled in a degree, a second medicine solution for treatment is applied to the hair to carry out the same operation.

Meanwhile, it takes a long time to do the above natural cooling of the hair after the hair treatment by water vapor has been done in the conventional hair dressing device. This prolongs the time taken until the second medicine solution is applied.

This invention intends to solve such a problem, and hence the second object of this invention is to provide a hair dressing device equipped with a hood which can shorten a cooling time by blowing from a blower because water vapor supply from a water vapor generator and ventilation from the blower are performed for the hood, and hence shorten the time taken for hair treatment to shorten the time taken for the whole operation.

Further, in a conventional hair dressing device equipped with a hood, water drops deposited on the inner wall of a hood are trapped into a drain tank from a water path formed in an opening of the hood through a flexible pipe. The one end of the flexible pipe is secured to the water path of the hood whereas the other end thereof is removably attached to the inlet of the drain tank.

Meanwhile, when the atmospheric pressure in the hood increases to a prescribed value because of supply of water vapor into the hood, the water vapor as well as the water drops will invade the drain tank. In this case, since the water vapor contains the odor of a medicine solution applied to a subject's hair, the odor leaks from the drain tank and the water vapor leaks out from the inlet of the drain tank. Thus, water drops are deposited to an exterior component such as an exterior cover so that the exterior component may be damaged.

Since the above flexible pipe is secured to the hood and drain tank, it is bent when the hood is opened/closed and hence may be damaged. Further, because of the presence of the flexible pipe, load is applied to an opening/closing movement of the hood.

This invention intends to solve the above problem, and the third object of this invention is to provide a hair dressing device in which odor or water drops do not leak out from a drain tank, and a flexible pipe does not bend or load is not applied to an opening/closing movement of the hood in such a manner that the flexible pipe moves in the drain tank when the hood is opened/closed.

SUMMARY OF THE INVENTION

In order to attain the first object of this invention, in accordance with the first aspect of this invention, there is provided a hair dressing device equipped with a hood comprising:

a fixed hood and an opening/closing hood into which the hood is divided, the opening/closing hood being openably attached to the fixed hood, wherein the opening/closing hood is opened/closed so that the fixed hood is opened from above. Further, the opening/closing hood is opened at a rotating fulcrum of a front side thereof from a state where the opening/closing hood is put on a subject's head.

As described above, the hood is divided into the fixed hood and the opening/closing hood. The opening/closing hood is opened/closed so that the fixed hood is opened from above. Therefore, even where the operation is done using two kinds of medicine solutions, the second medicine solution can be applied to the subject's hair by opening the opening/closing hood without moving the entire hood vertically. In addition, since the operation can be carried out from behind the subject, the operation can be done easily and in a reduced time.

In a preferred embodiment, the opening/closing hood is urged in its opening direction by a spring at a rotating fulcrum, and is adapted lockable in a closed state at the side of the fixed hood.

In this configuration, the subject will not be injured nor surprised owing to closing of the opening/closing hood during the operation. The opening/closing hood will not be inadvertently opened in the closed state. Thus, during the operation, the water vapor or cold wind will not leak externally.

Further, in a preferred embodiment, the opening/closing hood is provided with a damper at the rotating fulcrum so that the opening/closing hood is gently rotated in its closing direction.

In a preferred embodiment of this invention, the opening/closing hood is provided with a plurality of water vapor draining pores made at predetermined positions, and a flange which projects from an inner wall of each of the draining pores is formed integrally to or separately from each the draining pores to prevent water drops from flowing out from each the draining pores in a state where the opening/closing hood is opened.

In this configuration, even when the opening/closing hood is opened after hair dressing, it is possible to prevent the water drops from soiling the cloth of the subject or floor.

In a preferred embodiment, the fixed hood is vertically rotatably attached to a device body which incorporates a water vapor generator necessary for hair dressing, and when the fixed hood is opened beyond a prescribed angle from the device, the fixed hood is opened by urging force of rotating the fixed hood upward body, and when the fixed hood is closed to the prescribed angle or lower, weights of the opening/closing hood and the fixed hood overcome the urging force so that the fixed hood is closed.

In this configuration, the hood can be fixed at at least an upright position or horizontal position without using any locking means, and when the hood is rotated toward the horizontal direction, the hood will not be rotated abruptly. Thus, the hood will not hit against the subject's head and the subject will not be surprised.

In a preferred embodiment, the hair dressing device further comprises a face guard made of cloth or synthetic resin whose outer periphery is attached to the fixed hood at a position in the vicinity of an opening of the fixed hood and whose inner periphery is intimately attached to a circumference of a subject's head at a position where the subject's hair is located on the side of the opening/closing hood.

In this configuration, since the face guard is attached to the subject's head to remove the gap between the subject's head and the opening of the fixed hood. Thus, the water vapor in the hood D will not touch the face of the subject so that the subject does not feel hot or unpleasant.

In a preferred embodiment, the hair dressing device further comprises an elastic sealing ring attached to the inside of an outer periphery of either the fixed hood or the opening/closing hood to prevent water vapor from leaking from a boundary between the fixed hood and the opening/closing hood; and a locking member composed of a magnet and a magnetic substance located at the boundary so that the sealing member is in intimate contact with the fixed hood and the opening/closing hood in a state where the opening/closing hood is closed for the fixed hood.

In this configuration, the water vapor will not leak externally from the hood and hence can be effectively employed for the operation.

In order to attain the second object of this invention, there is provided a hair dressing device comprising:

a hood to be put on a subject's head which is hair-dressed by water vapor supply;

a water vapor generator for supplying water vapor into the hood through a first pipe; and a blower for supplying wind for cooling through a second pipe after the subject' head has been hair-dressed.

In this configuration, after the hair has been dressed using the water vapor supplied from the water vapor generator into the hood, the hair is cooled using the wind supplied from the blower. This configuration shortens the cooling time after the hair dressing. Therefore, where the hair is dressed using two kinds of two medicine solutions, the time taken from application of the first medicine solution to that of the second medicine solution is shortened, and hence the time taken for hair treatment and for the whole operation can be shortened.

In a preferred embodiment, the hair dressing device further comprises a cover attached to the second pipe, the cover closing while the wind is not supplied and swings to open because of wind pressure while the wind is supplied into the hood. Further, the first pipe and the second pipe are coupled to constitute a two-way pipe. While the water vapor is supplied into the hood from the water vapor generator, an inside of the second pipe is in a negative pressure state so that water vapor does not invade the blower.

In these configurations, the water vapor will not invade the blower so that the failure of the blower due to rust or moisture can be prevented. In the case of the two-way pipe configuration, the wind supplied from the blower does not invade the water vapor generator so that the hot water in the water vapor generator is prevented from being cooled.

In a preferred embodiment, the hair dressing device further comprises a diffusing plate attached to the hood at its water vapor and wind discharging positions, respectively, the diffusing plates diffusing the water vapor and wind supplied from the water vapor generator and blower into the hood.

In this configuration, the entire hair is uniformly sprayed with the water vapor and wind and hence can be effectively dressed.

In a preferred embodiment, a water path is formed in an opening of the hood to receive water drops from an inner periphery of hood, the water path has a hole made at the lowest position when the hood is opened, and a drain tank is removably attached to the hole.

In this configuration, the water drops deposited on the inner wall of the hood are trapped in the drain tank via the water path in the opening of the hood. Therefore, the clothes of the subject or floor will not be soiled owing to the water drops. In addition, since the drain tank can be detached, the water drops can be easily disposed.

In a preferred embodiment, the hair dressing device comprises a hood to be put on a subject's head which is hair-dressed by water vapor supply, the hood being attached to a device body post;

a water vapor generator incorporated in the device body post for supplying water vapor into the hood, an operating portion for controlling the water vapor generator, formed on the upper surface of the device body post, the operating portion being located at a rearward position on a center line of the hood and rearward aslant.

In such a configuration, various settings by the operating portion can be made easily and effectively by the operator.

In a preferred embodiment, the hair dressing device comprises a hood to be put on a subject's head which is hair-dressed by water vapor supply, the hood being attached to a device body post;

a water vapor generator incorporated in the device body post for supplying water vapor into the hood; and a water supply tank for supplying water to the water vapor generator, which is attached to the device body post and adapted to be detachable aslant behind the device body post.

In this configuration, the water supply into the water vapor generator can be easily done.

In a preferred embodiment, the hair dressing device comprises a hood to be put on a subject's head which is hair-dressed by water vapor supply, the hood being attached to a device body post;

a water vapor generator incorporated in the device body post for supplying water vapor into the hood;

a water supply tank for supplying water to the water vapor generator, which is attached to the device body post;

a drain valve for draining remaining water from the bottom of the water supply tank; and a drain cup located below the drain valve, which is detachable from the device body post.

In this configuration, where the water in the water supply tank has become unnecessary, the drain valve is opened and the water can be transferred into the drain cup which is detachable from the device body post. Therefore, when the operator is free, the drain cup is removed from the device body post so that the water in the drain cup can be drain easily and at any optional time.

In order to attain the third object of this invention, in accordance with this invention, there is provided a hair dressing device comprising:

a hood to be put on a subject's head which is hair-dressed by water vapor supply, the hood being attached to a device body post;

a water path formed by folding back the inner periphery of the hood;

a flexible pipe with the one end attached to the outlet of the water path; and a drain tank into which the other end of the flexible pipe can be inserted, wherein the drain tank comprises:

an inlet formed in an upper face of the drain tank;

a first trapping portion for trapping the water flowed via the water path and the flexible pipe, the flexible pipe being slidably inserted into the drain tank from the inlet so that the other end of the flexible pipe reaches a lower end of the first trapping portion; and a second trapping portion formed below the first trapping portion, for trapping the water overflowed from the first trapping portion.

In this configuration, odor and water drops will not leak out from the drain tank.

In a preferred embodiment, the drain tank further comprises a guide portion formed between the first trapping portion and the inlet, for guiding the flexible pipe to the first trapping portion.

In this configuration, when the hood is opened or closed, since the flexible pipe moved within the drain tank while it is being guided by the guiding portion, the flexible pipe will not be bent and load is not applied to the hood.

The above and other objects and features of the invention will be more apparent from the following description taken in conjunction with the accompanying drawings.

DESCRIPTION OF THE PREFERRED EMBODIMENTS

Aspect 1

Figure 1:
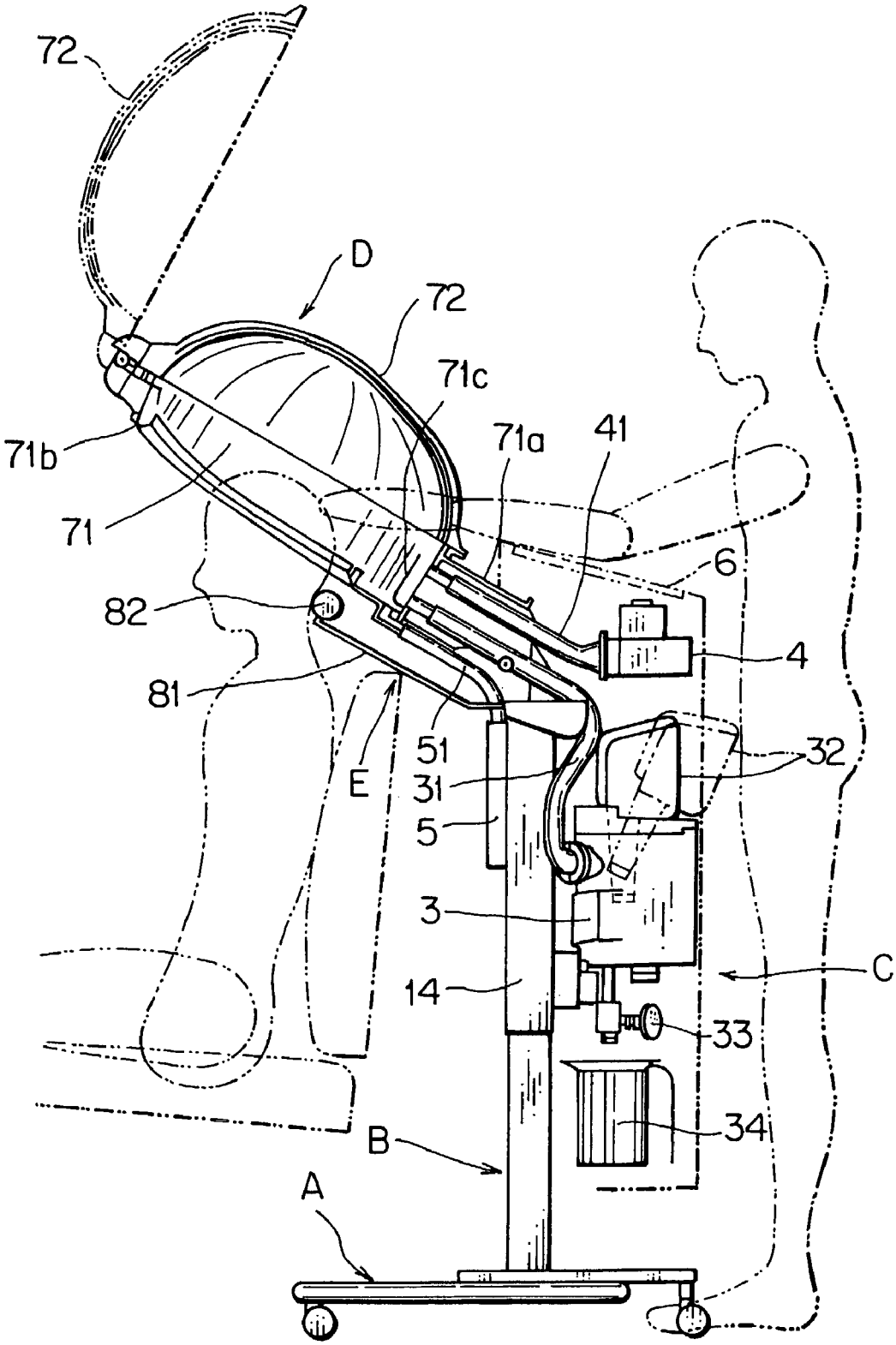
FIG. 1 is a side view of an entire hair dressing device equipped with a hood according to this invention.

Now referring to the drawings, an explanation will be given of an embodiment of a hair dressing device equipped with a hood according to the first aspect of this invention.

FIG. 1 shows an entire structure of the hair dressing device equipped with a hood according to this invention.

As seen from FIG. 1, the hair dressing device includes a base plate A equipped with a caster, a supporting post B fixed to the base plate A, a device body C attached to the supporting post B, a hood D which is attached to the upper portion of the device body so that the hood is vertically rotatable and fixable and a neck receiver E. The device body C incorporates a vertical movement mechanism, a water tank, a water vapor generator for water vaporizing the water stored in the water tank, a blower, a drain cup for receiving the water drained from a water supply tank, a drain receiver for receiving the hot water built up in the hood D, and is provided with an operating portion for setting the driving times of the water vapor generator and blower. The device body is entirely covered with a cover. The neck receiver E is brought into contact with the back of the neck of the subject sitting in a chair to position the subject's head relatively to the hood D.

Now referring to FIGS. 2 and 3, an explanation will be given of the concrete configuration of the device body C.

Figure 2:
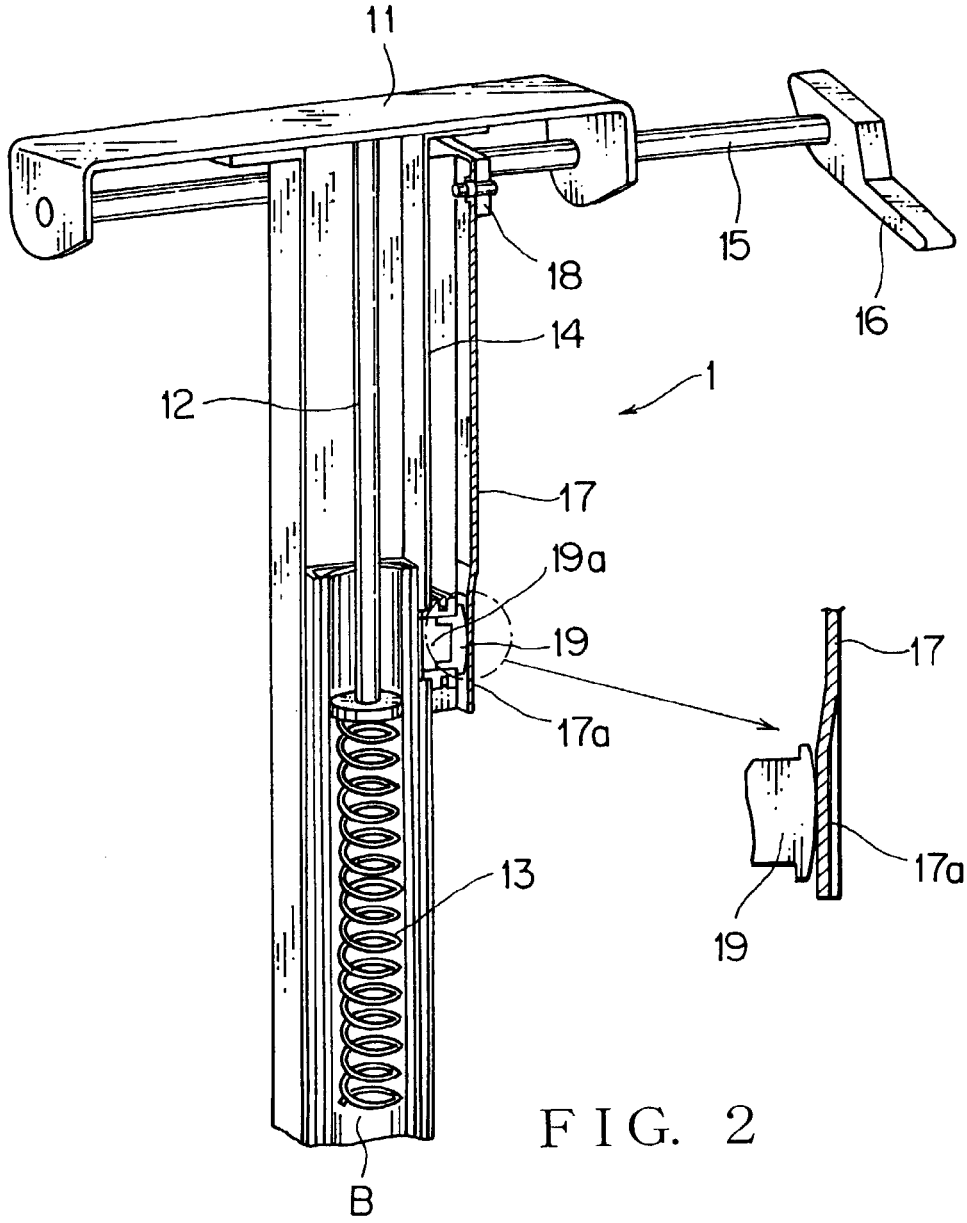
FIG. 2 is a sectional view of a vertical movement mechanism in the hair dressing device.

With reference to FIG. 2, a first embodiment of a vertical movement mechanism will be explained. In FIG. 2, reference numeral 11 denotes a base plate to which the above hood D and the neck receiver E are attached. Reference numeral 12 denotes a shaft rod which dangles downward from the back of the base plate. The lower end of the shaft rod 12 is in contact with the upper end of an elastic member 13 such as a spring inserted in the supporting post B so that the base plate 11 is always upward urged by spring force.

A vertical movement tube 14 is attached to the back of the base plate 11 to be slidable relatively to the supporting post B. A rotary shaft 15 which is rotatably attached to the base plate 11 is provided with a handle 16 at the tip. The rotary shaft 15 is also provided with a brake presser 17 which is ⊐-shaped in the free section relative to the vertical movement tube 14. Therefore, as the handle 16 is revolved, the brake presser 17 moves vertically relatively to the vertical movement tube 14.

The brake presser 17 has a convex face 17*a* formed in the longitudinal direction at the lower end so as to close toward the vertical movement tube 14. A brake 19 is attached to the vertical movement tube 14 so that the brake 19 is movable in a direction perpendicular to the vertical movement tube 14 and is provided with a brake pad 19*a* in slidable contact with the supporting rod B. The brake presser 17 is only vertically movable relatively to the vertical movement tube 14 through the brake 19.

In the vertical movement mechanism 1 having the configuration described above, as seen from FIG. 2, when the handle 16 is made horizontal so that the brake 19 moves to the supporting post B by the convex face 17*a* of the brake presser 17, the break pad 19*a* is brought into press-contact with the supporting post B. Thus, the vertical movement tube 14 is fixed to the supporting post B against the spring force.

The base plate 11 is raised as follows. When the handle 16 is revolved by about 90° from the state of FIG. 2, the brake presser 17 rises relatively to the vertical movement tube 14. Then, the convex face 17*a* of the brake presser 17 leaves the brake 19 so that the press-contact force between the brake pad 19*a* and the supporting post B is released, thereby allowing the vertical tube 14 to be in a free state.

In this state, since the spring force by the elastic member 13 is upwards exerted to the vertical movement tube 14, the vertical movement tube 14 can be easily raised. The vertical movement tube 14 can be lowered against the spring force of the elastic member 13. By rotating the handle 16 to the previous position at a desired raised position or lowered position, the brake pad 19*a* is brought into press-contact with the supporting post so that the brake pad 19*a* can be fixed to the supporting post B at that position.

Figure 3:
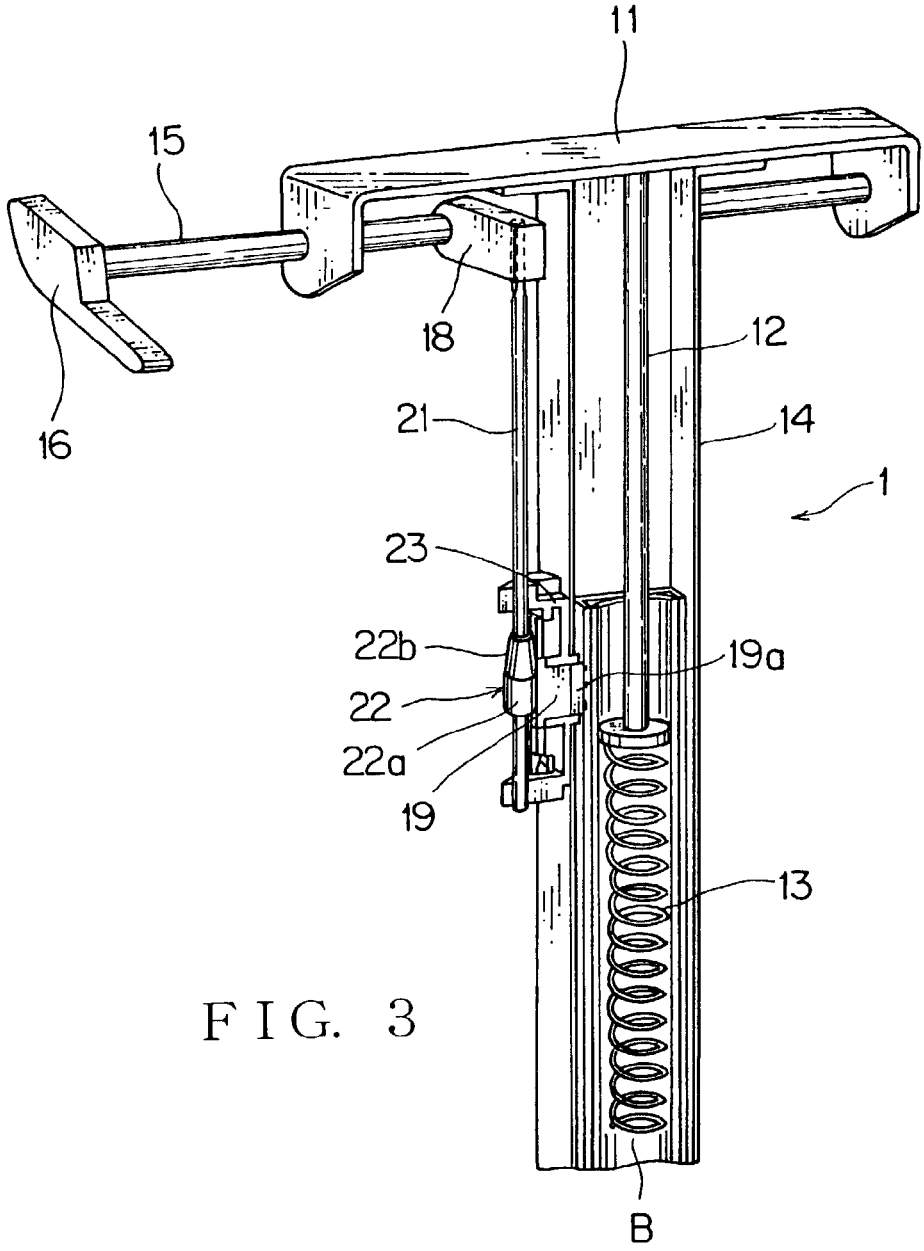
FIG. 3 is a sectional view of another example of the vertical movement mechanism.

With reference to FIG. 3, another vertical movement mechanism 2 will be explained below. In FIG. 3, like reference numerals refer to like elements in FIG. 2.

In this embodiment shown in FIG. 2, in order to fix the vertical movement tube 14 to the supporting post B by the brake 19, the brake pad 19*a* is brought into press-contact with the supporting post B by the convex face 17*a* of the brake presser 17.

On the other hand, in this embodiment, a conical brake presser 22 is attached to a vertical movement axial rod 21 which is moved vertically through a link 18 by rotating a handle 16; the brake pad 19*a* of the brake 19 is brought into press-contact with the supporting post B by a large diameter portion 22*a* of the conical brake presser 22; and when a small diameter portion 22*b* is located at the brake 19, the above press-contact force is released. Incidentally, reference numeral 23 denotes an attaching piece for attaching the brake 19 to the vertical movement tube 14. The vertical movement tube 14 is guided by the attaching piece 23.

Referring to FIG. 1, the water vapor generator 3 of the device body C will be explained.

The case of the device body C incorporates the water vapor generator 3 fixed to the vertical movement tube 14. The water vapor generated by the water vapor generator 3 is derived into the hood D through a flexible pipe 31. The water vapor generator 3 is provided with a water supply tank 32 at the lower part. The water supply tank 32 is adapted to be detachable from obliquely above. The water supply tank 32 is designed as a part of the case in a state where the water supply tank 32 is housed in the case. The water supply tank 32 is designed so that when it is installed in a tank receiver, its lower part is opened, and the water in the water supply tank 32 is exhausted by opening an exhaust valve 33.

Below the drain valve 33, a drain cup 34 which is detachable from the case is located. Upon completion of the operation, by opening the exhaust valve 33, the water contained in the water supply tank 32 is drained into the drain cup 34.

The case of the device body 3 incorporates a blower 4 composed of a motor and fan attached to the vertical movement tube 14. The cold wind supplied from the blower 4 is derived into the hood D through a flexible pipe 41 vertically in parallel to the flexible pipe 31.

The case of the device body C incorporates a drain tank 5 for trapping the water supplied from a water path 71*b*, which is formed by folding back the inner periphery of the hood in order to exhaust the water changed in the hood from the water vapor. The drain tank 5 is attached to the vertical movement tube 14 in such a manner that it can be detached by being screwed into the tip of a pipe 51 coupled with the water path 71*b*.

An operating portion 6 is attached to the upper face of the case of the device body C. The operating portion 6 is inclined backward so that it can be easily operated. The operating portion 6 is provided with a control circuit for automatically controlling the ON/OFF and generating time of the water vapor generator 3, driving time of the blower 4 and switching from the water vapor generator 3 which has been turned off into the blower 4.

Figure 4:
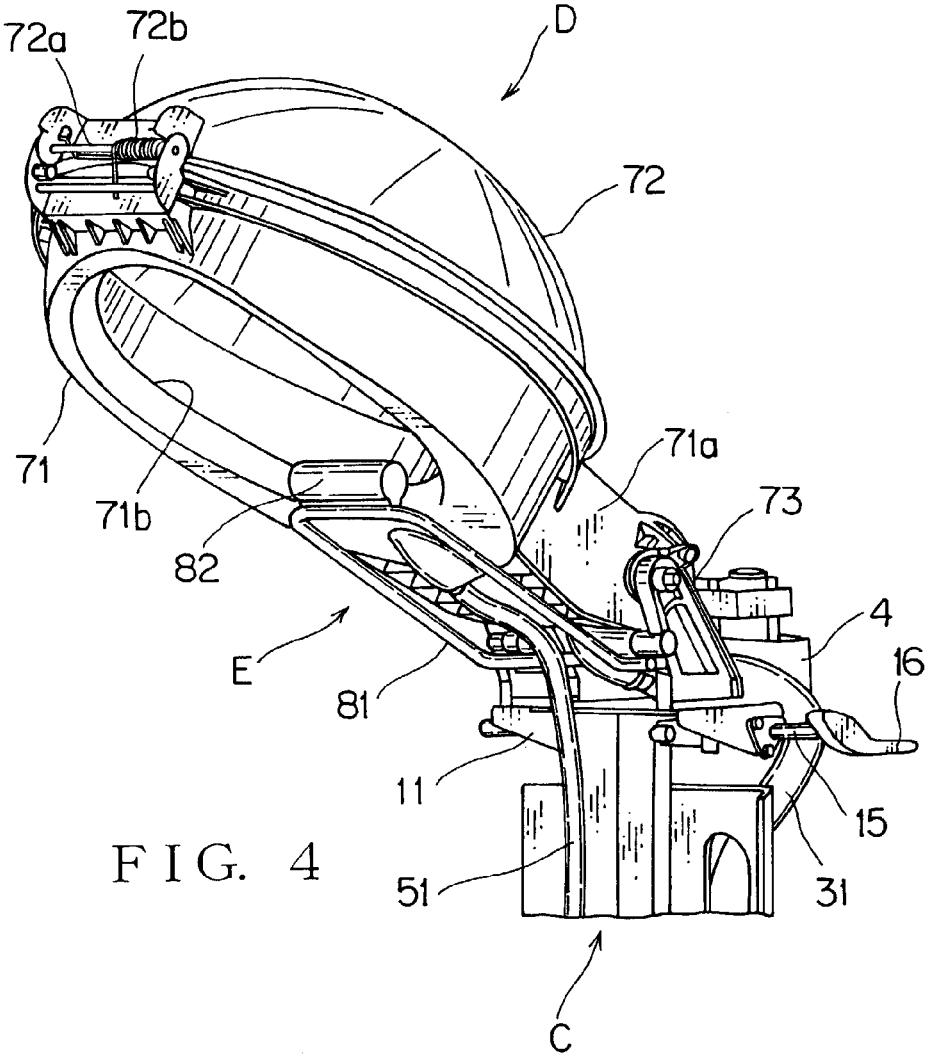
FIG. 4 is a perspective view of a hood in a covering state.
Figure 6:
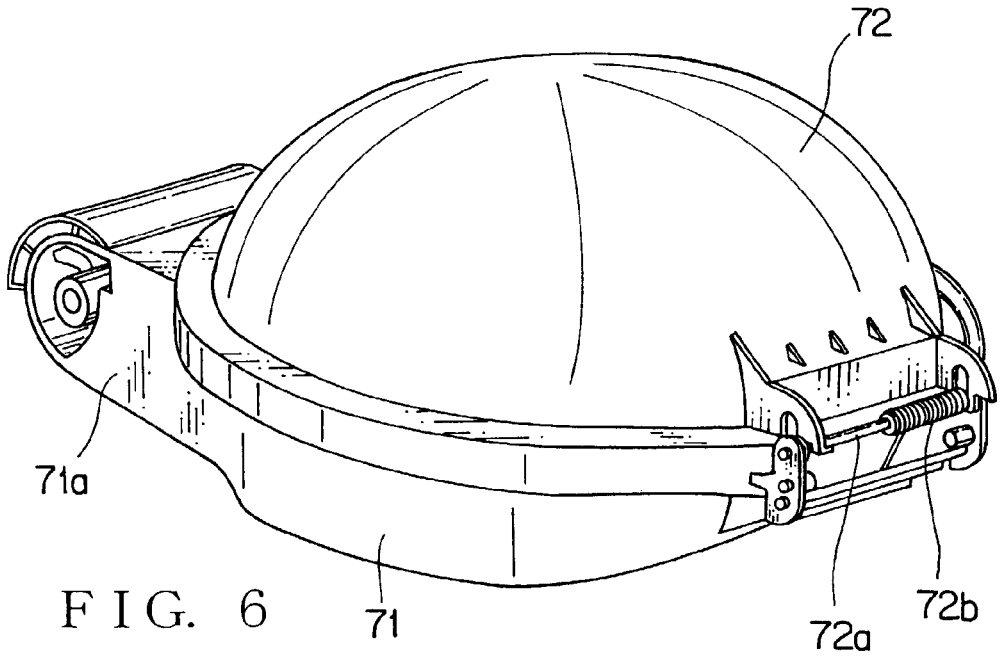
FIG. 6 is a perspective view of a hood in a closed state.
Figure 5:
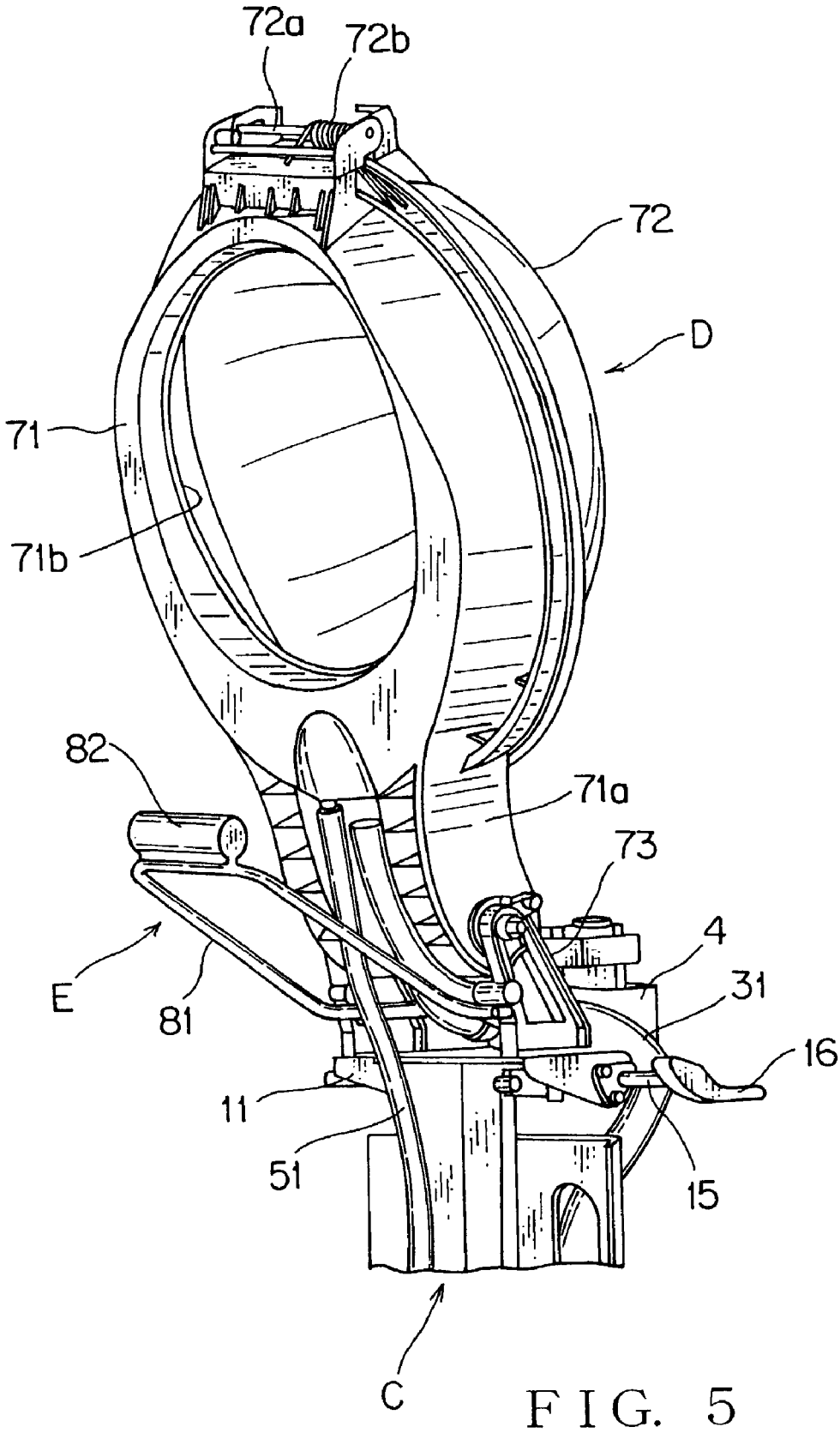
FIG. 5 is a perspective view of a hood in an upright state.
Figure 7:
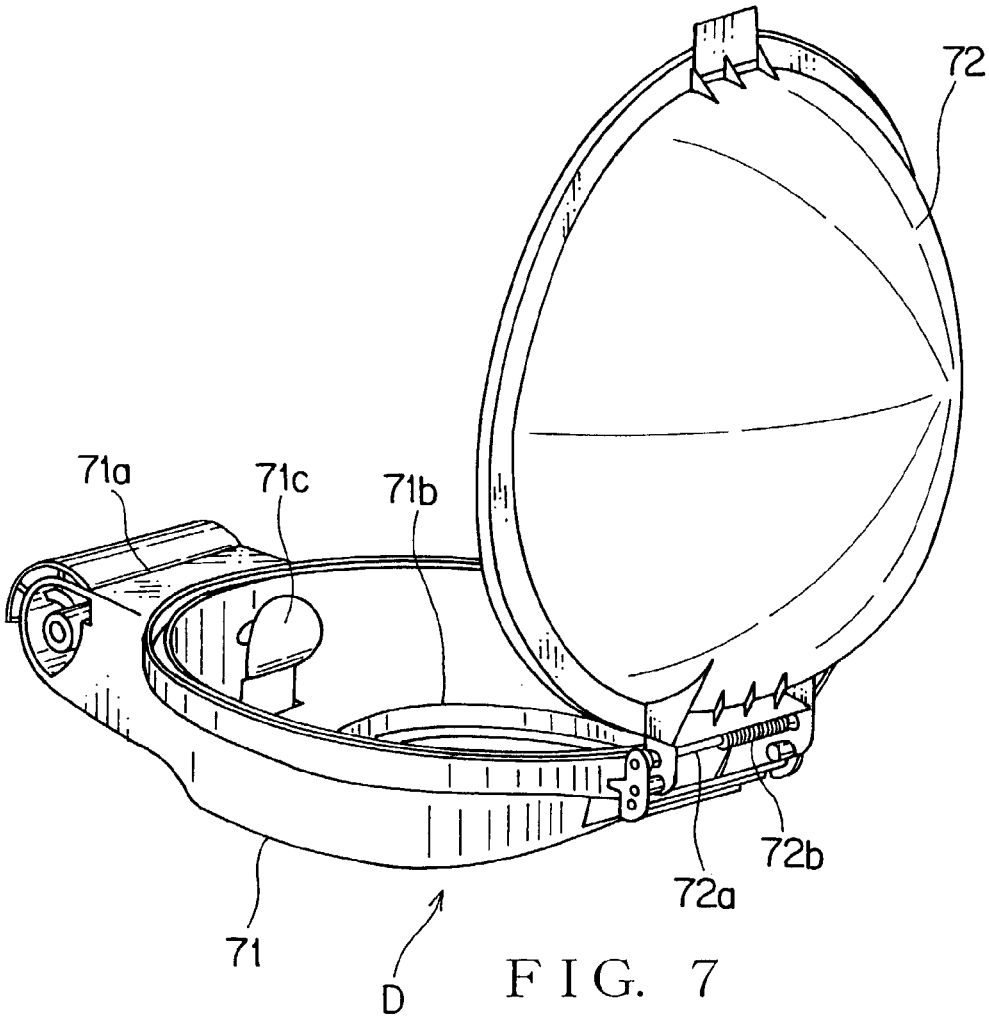
FIG. 7 is a perspective view of a hood in an opened state.

Referring to FIGS. 4 to 7, the structure of the hood D will be explained. The hood D includes a fixed hood 71 and an opening/closing hood 72 supported to the front of the fixed hood 71. The base end 71*a* of the fixed hood 71 is rotatably supported to a pair of plates 73 upright attached to the base plate 1 which is vertically movable so that it can be locked between two positions of a horizontal state (FIG. 4) and an upright state (FIG. 5).

The fixed hood 71 is provided, at its opening, with a folded-back water path 71*b* on the entire inner periphery. The water path 71*b* has a hole which communicates with the pipe 51 at the lowest position. The water trapped in the water path 71*b* is trapped in the drain tank 5 through a pipe 51 from the hole.

The opened tips of the flexible pipes 31 and 41 are attached to the side of the upright plates 73 of the fixed hood 71. A diffusing plate 71*c* is attached to the inner periphery of the fixed hood 71 at the position correspond to the flexible pipes 31 and 41. The diffusing plate 71*c* serves to spray the water vapor and cold wind to the head from the entire periphery without directly spraying them to the rear of a subject's head.

The entire opening/closing hood 72 is designed in a double structure to provide a thermal insulation effect. The opening/closing hood 72 is openably supported by a shaft 72*a* at the tip of the fixed hood 71, and spring-urged by a helical spring 72*b* in a direction of closing the opening/closing hood 72. The opening/closing hood 72 is formed to be locked at the base end of the fixed hood 71. Incidentally, a locking mechanism may be adapted so that a magnet is attached to the fixed hood 71 and a magnetic material is attached to the opening/closing hood 72. The locking mechanism may be a known locking mechanism which can perform locking/unlocking.

Referring to FIGS. 4 and 5, an explanation will be given of the neck receiver E.

The neck receiver E includes an arm 81 whose stem is secured to the upright plate 73 and a neck contact 82 secured to the tip of the arm 81. When the hood D is put on a subject's head with the neck contact being in contact with the back of the neck of the subject, the subject's head is located at the center of the hood D. The neck contact is formed in a cylindrical shape and made of an elastic material which permits the neck contact to be used as a pillow pad.

An explanation will be given of the operation of dressing the subject's hair on the basis of the configuration described above.

First, in a state where the hood D has been rotated upward, the subject with a first medicine solution for e.g. treatment being applied on the hair is caused to sit on a chair. Next, the handle 16 is rotated to lower the brake presser 17 or conical brake presser 21 so that the height of the device body C is adjusted with the brake pad 19*a* of the brake 19 being separated from the supporting post B. Thus, the position of the subject's head is adjusted so that the neck contact 82 of the neck receiver E is located at the back of the neck of the subject. Thereafter, the handle 16 is rotated to the initial position so that the brake pad 19*a* is brought into press-contact with the supporting post B, thereby securing the device body C to the supporting post B.

In this state, with the hood D being put on the subject's head, the operating portion 6 is operated to set the time suitable for the above applied medicine solution and the subsequent operating time of the blower. Thus, the water vapor generated from the water vapor generator 3 is supplied into the hood D through the flexible pipe 31. By the diffusing plate 71*c* attached to the fixed hood 71, the water vapor is sprayed over the entire interior of the hood D so that moisture is given to the hair, thereby dressing the hair.

When the operation of the water vapor generator 3 is ended, the blower 4 is subsequently operated so that cold wind is supplied into the hood D through the flexible pipe 41. Like the above case, by the diffusing plate 71*c*, the cold wind is sprayed on the hair from the entire interior of the hood D to dry the hair.

Upon completion of the hair dressing by the first medicine solution, the locking between the opening/closing hood 72 and the fixed hood 71 is released. The opening/closing hood 72 is opened forward so that the back of the subject is seen from the operator who stands behind. Incidentally, when the opening/closing hood 72 is once opened, the opened state of the opening/closing hood 72 is maintained by spring force.

After a second medicine solution has been applied to the subject's hair, the opening/closing hood 72 is closed and locked. The operating portion is operated again to set the water vapor generating time and cold wind generating time, thereby dressing the hair. Upon completion of the hair dressing, the handle 16 is rotated to separate the brake pad 19*a* from the supporting post B and raise the device body C. The subject is caused to leave the chair. Thus, the entire operation of the hair dressing is ended.

Incidentally, in the embodiment described above, the opening/closing hood 72 has been opened/closed vertically at the forward position of the fixed hood 71. However, the opening/closing hood 72 may be opened/closed horizontally, otherwise, the two halves into which the opening/closing hood 72 is divided may be slid horizontally, respectively so that the subject's head is seen from behind.

Meanwhile, since the interior of the hood D is placed in a pressurized state by the supplied water vapor, generally, the hood has a water vapor draining pore for slightly draining the water vapor. Where a water vapor draining pore 72*c* is provided in this invention also, since the opening/closing hood 72 is opened upward upon completion of the hair dressing, the water drops put on the inner wall of the opening/closing hood 72 leak externally. As a result, the clothes of the subject or floor may be soiled.

Figure 9:
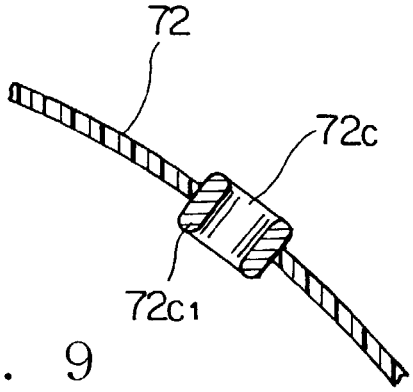
FIG. 9 is a sectional view of a portion of a water vapor draining vent.
Figure 10:
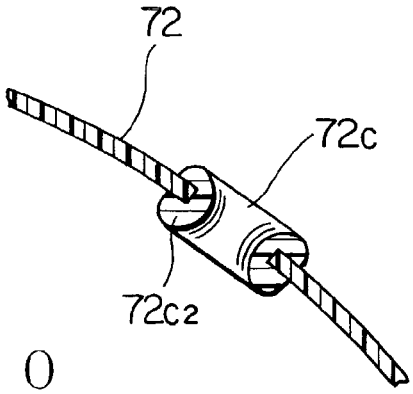
FIG. 10 is a section view of a portion of another water vapor draining vent.
Figure 8:
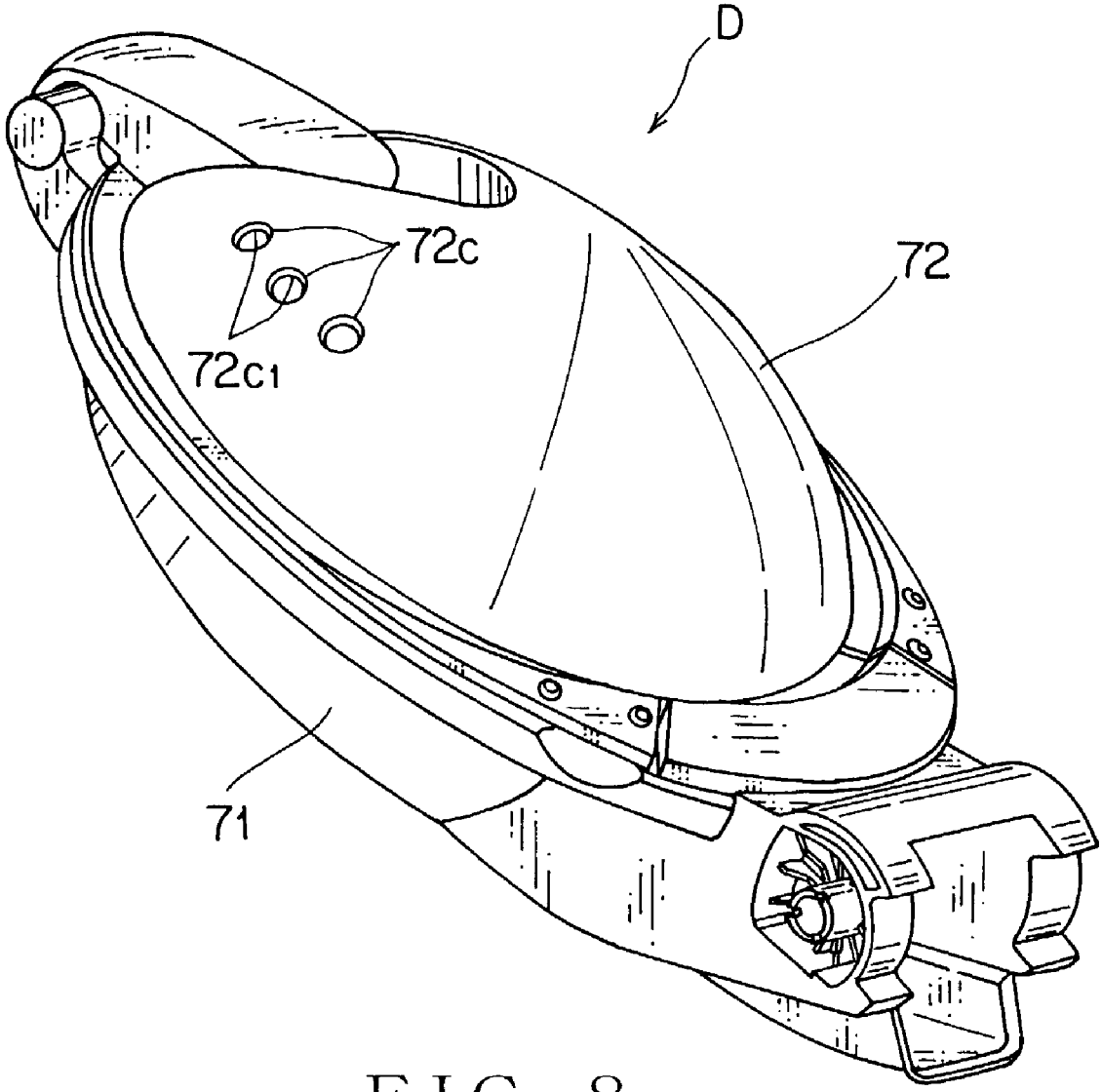
FIG. 8 is a perspective view of a hood equipped with water vapor draining vents.

In accordance with this invention, as seen from FIGS. 8 and 9, on the rear side of the water vapor draining pore 72*c*, a flange 72*c*1 is made along the periphery of the water vapor draining pore 72*c*, or otherwise, as seen from FIG. 10, a ring 72*c*2 of synthetic resin is fit in the water vapor draining pore 72*c* to form the flange. In this case, even when the water drops flow in the direction of the water vapor draining pore 72*c* as a result that the opening/closing hood 72 is opened, the water drops are interrupted by the flange 72*c*1 or 72*c*2 and do not flow externally. Thus, the cloths of the subject or floor will not be soiled.

The rotating mechanism for rotating the base end 71*a* of the fixed hood 71 employed in the embodiment is rotatably supported to the upright plate 73 on the base plate 1 and can lock the hood D in an upright state and a horizontal state. However, where the hood D is rotated from the locked upright state or the horizontal state, the hood D is placed in a free state. Therefore, the hood D may be rotated horizontally because of its own weight and hence may hit against the subject's head.

Figure 11:
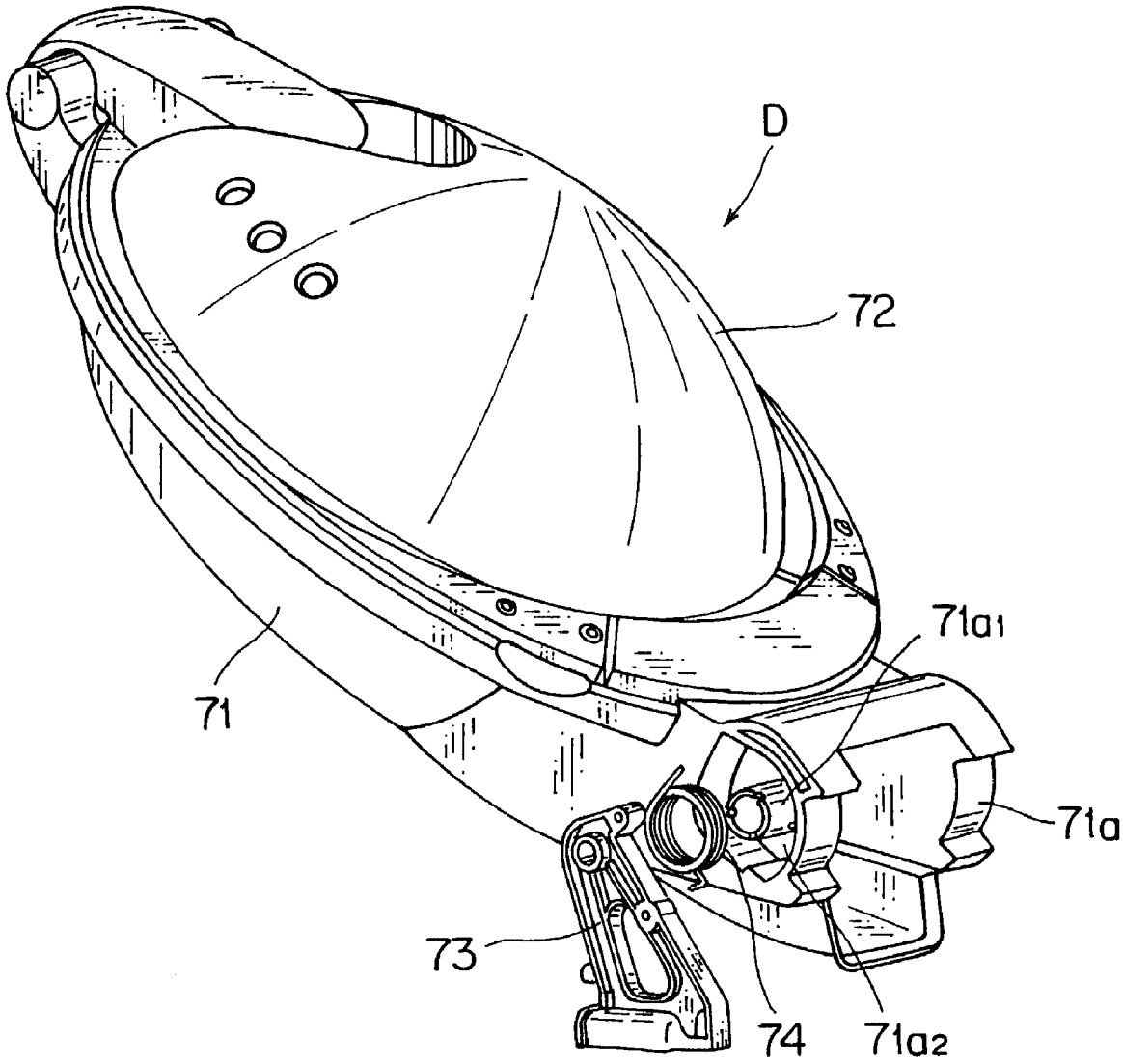
FIG. 11 is a perspective view of an attaching portion between a hood and a device body.

In order to obviate such inconvenience, in accordance with this invention, as shown in FIG. 11, a ring-shaped space 71*a*2, which has a protrusion 71*a*1 at the center on both sides of the base end 71*a* in the fixed hood 71, is formed. A helical spring 74 is fit over the protrusion 71*a*1 so that the helical spring 74 is accommodated within the space 71*a*2. The one end of the helical spring 74 is secured to the base end 71*a* whereas the other end thereof is secured to the upright plate 73.

Figure 12:
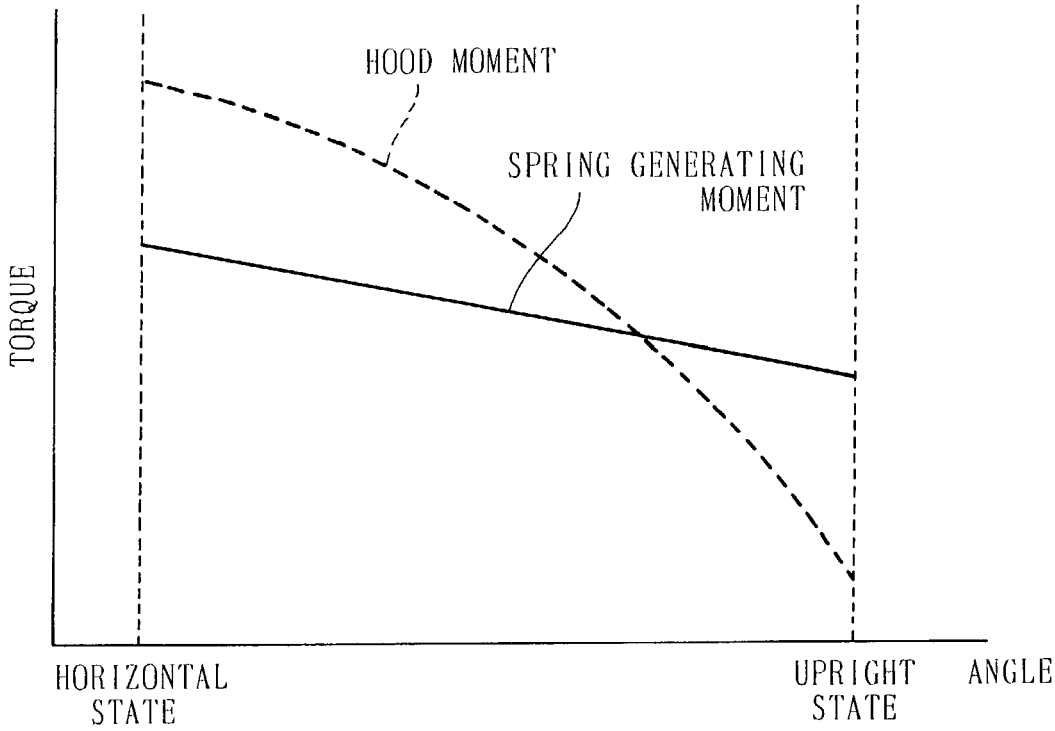
FIG. 12 is a characteristic graph of a helical spring used for the attaching portion.

Although not shown, the base end 71*a* and the upright plate 73 are rotatably supported. The locking means at the above two positions are also not shown. As shown in FIG. 12, the spring generating moment of the helical spring 74 is larger than the hood moment (moment by the weight of the hood D) at a prescribed position until which the hood D changes toward the horizontal direction, and when the hood D passes the prescribed position, the hood moment gradually becomes larger than the spring generating moment.

In accordance with such a configuration, since in the upright state of the hood D, the spring generating moment is larger than the hood moment in their torque, the hood D is maintained in the upright state. When the operator pushes the hood D toward the horizontal direction from the upright position, the hood is urged to return to the upright position since the spring generating moment is larger than the hood moment until the crossing point of the spring generating moment and the hood moment. At the position corresponding to the crossing point, the hood D is held at this position. When the operator further tilts the hood D toward the horizontal direction, since the hood moment gradually becomes larger than the spring generating moment, the hood D is gradually shifted and eventually rotated to the horizontal position which is an operation position. Incidentally, a damping means by hydraulic pressure may be adopted in place of the helical spring 74 as long as it has the characteristic as shown in FIG. 12.

Thus, in the upright state, the hood D is maintained at the upright position by the spring force by the helical spring 74. The hood D is rotated until the prescribed position on the way of rotation toward the horizontal direction by only the force applied by the operator. When the hood D passes the prescribed position, the hood D is gradually rotated to the horizontal position owing to the weight of the hood D against the spring force. The hood D is eventually stopped at the operating position. Thus, the hood D can be fixed at the upright position and the horizontal position without using the locking means. In addition, while the hood D is rotated toward the horizontal direction, the hood D is not abruptly rotated so that the hood D does not hit against the subject nor surprise the subject.

Figure 13:
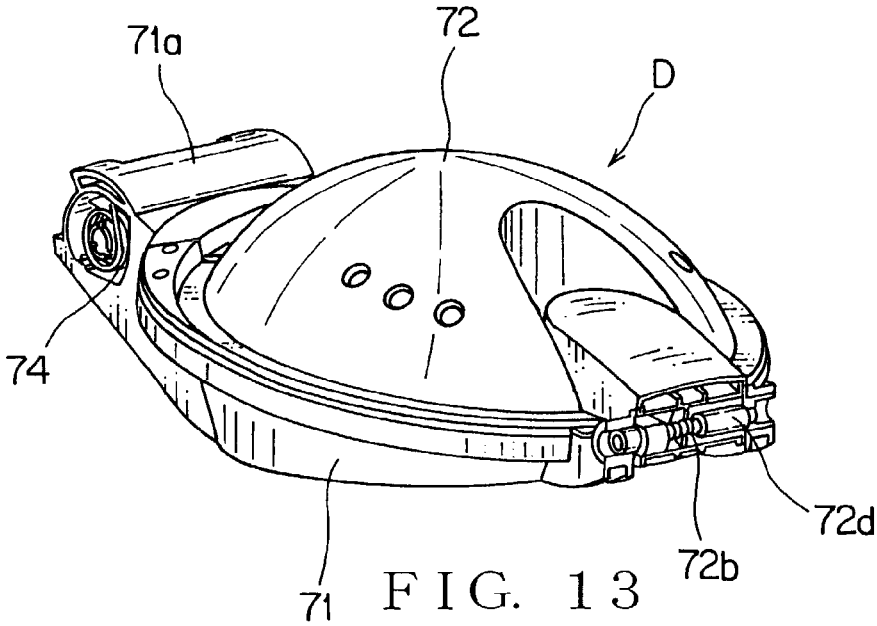
FIG. 13 is a perspective view of an attaching portion between a fixed hood component and an opening/closing hood component.

FIG. 13 shows an improved rotating mechanism for the fixed hood 71 and opening/closing hood 72. In the embodiment described above, the opening/closing hood 72 is urged using only the helical spring 72*b* in a direction in which the opening/closing hood 72 is closed. However, in this embodiment, the helical spring 72*b* and a damper 72*d* by hydraulic pressure are combined with each other so that the opening/closing hood can be opened/closed gently and smoothly for the fixed hood 71.

In a still another embodiment, only the damper 72*d* is placed between the opening/closing hood 72 and a shaft for supporting the opening/closing hood 72 and the fixed hood 71 so that when the opening/closing hood 72 is closed, it is gently closed by the function of the damper 72*d*, whereas when the opening/closing hood 72 is opened, it is pushed up by the operator.

In the embodiments described above, when the subject putting on the hood D is supplied with the water vapor, the water vapor trapped in the hood D is discharged downward from the opening of the water path 71*b* of the fixed hood 71. The water vapor thus discharged hits against the face of the subject so that the subject feels hot and unpleasant.

Figure 14:
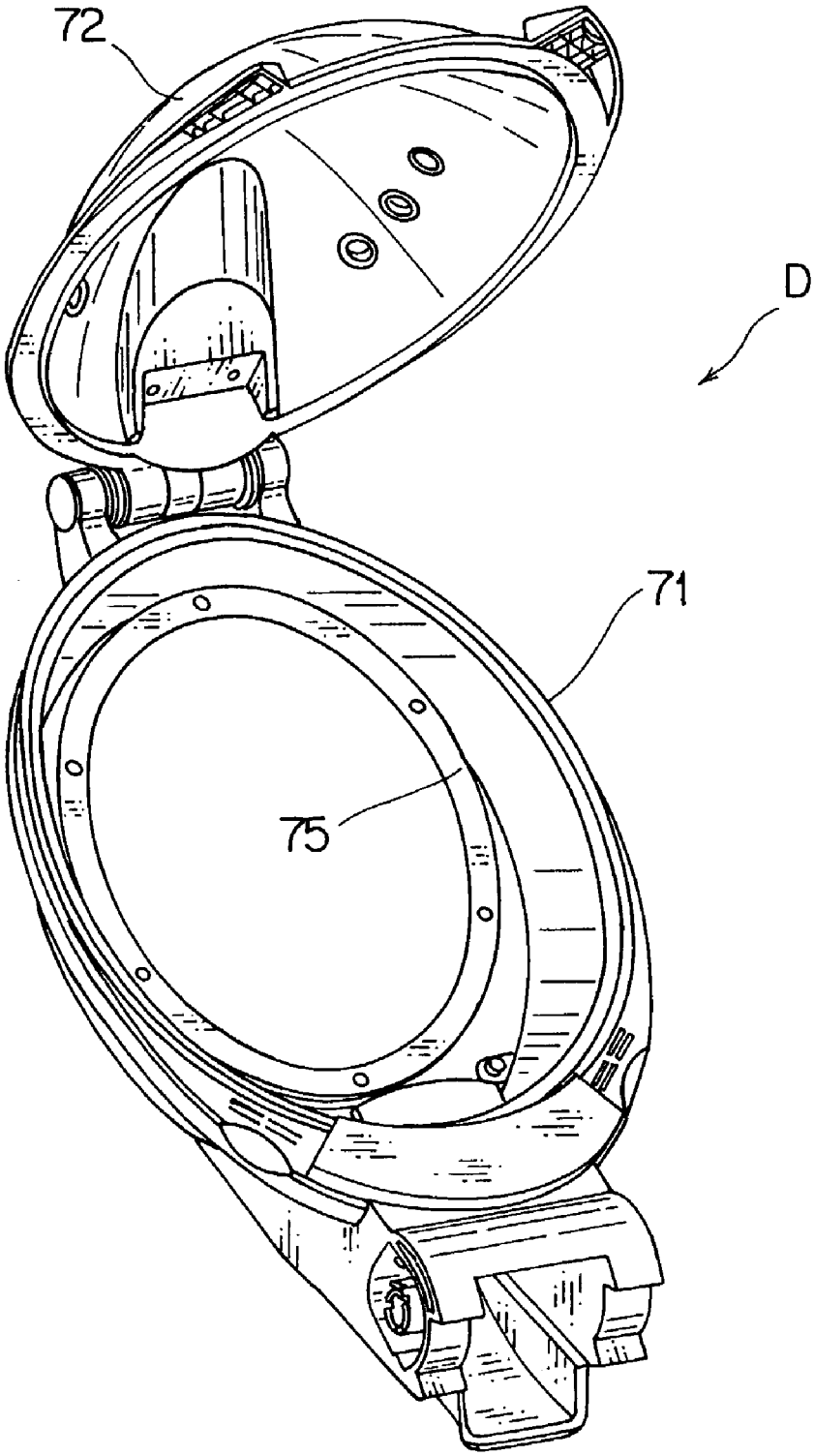
FIG. 14 is a perspective view of the hood in a state where the opening/closing hood component is opened for the fixed hood component to reveal a supporting plate.
Figure 15:
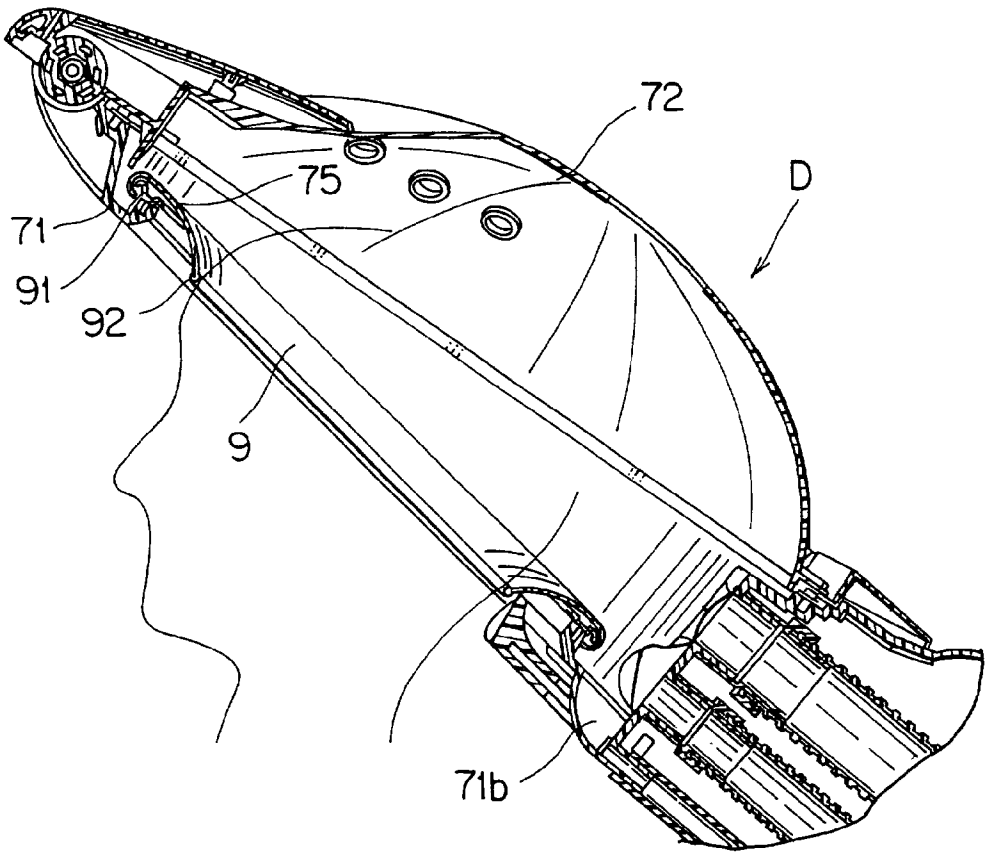
FIG. 15 is a sectional view of a hood to which a face guard.

In order to obviate such inconvenience, in accordance with this invention, as shown in FIGS. 14 and 15, a ring-shaped supporting plate 75 is attached to the upper side of the water path 71*b*. The ring-shaped supporting plate 75 serves to anchor the outer periphery of a ring-shaped face guard 9 which will be described later. The face guard 9 is made of cloth or film of synthetic resin. The face guard 9 is wide ring-shaped. The face guard 9 has a tightening tool 91 such as a string or wire for tightening the face guard attached along the supporting plate 75 on the outer periphery and another tightening tool 92 for tightening the face guard attached in intimate contact with the subject's head on the inner periphery. The tightening tools 91 and 92 each may be provided with a fastener for preventing the string or wire in the tightened state from being loosed.

With the outer periphery of the face guard 9 previously anchored to the supporting plate 75 of the fixed hood 71 using the tightening tool 91 and the hood D put on the subject, the opening/closing hood 72 is opened and the inner periphery of the face guard is fit over the subject's head and the subject's hair is dressed so that the hair of the subject is located at the upper side of the face guard 9. Thereafter, the tightening tool 92 is tightened so that the face guard 9 is anchored to the subject's head. The tightened state will not be loosed by the fastener.

In this way, the face guard 9 is attached to the subject's head to remove the gap between the subject's head and the opening of the fixed hood 71. Thus, the water vapor in the hood D will not touch the face of the subject so that the subject does not feel hot or unpleasant.

Figure 16:
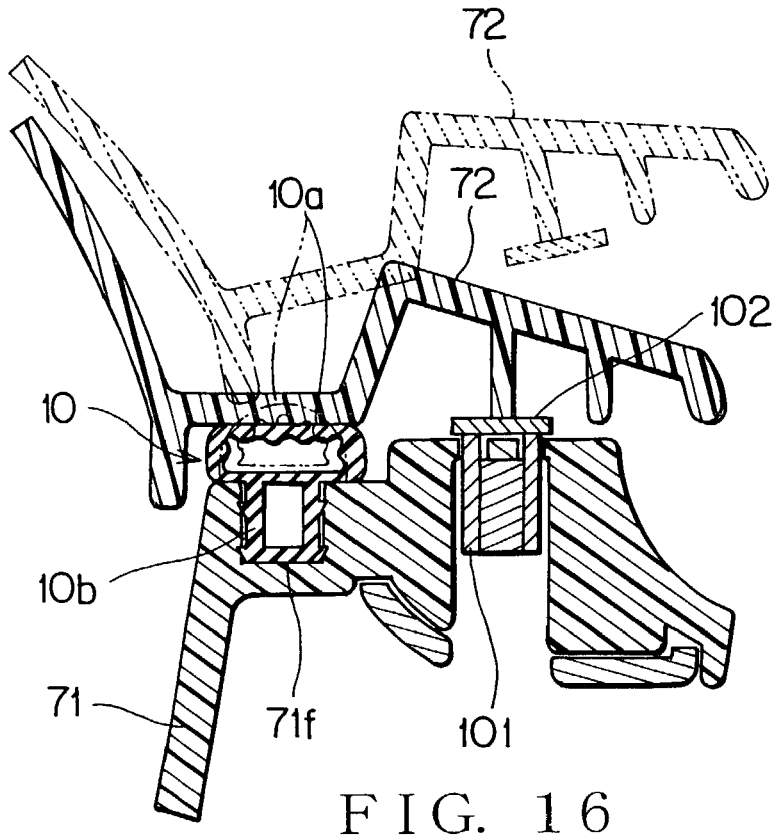
FIG. 16 is a partially enlarged view of a fixed hood component and opening/closing hood component in a packing-attached state.

In the embodiments described above, the entire hood D is made of synthetic resin so that a gap is generated in the contact plane between the fixed hood 71 and the opening/closing hood 72 and the water vapor may leak externally. In order to obviate such inconvenience, in accordance with this invention, as shown in FIG. 16, a sealing ring 10, which is composed of a hollow semi-sphere 10*a* and a hollow rectangular parallelepiped 10*b*, is fit on the side of the parallelepiped 10*b* in a ring-shaped groove 71*f* which is formed on the plane of the fixed hood 71 which abuts on the opening/closing hood 72 so that the semi-sphere 10*a* is in contact with the lower surface of the opening/closing hood 10*a*.

Incidentally, reference numeral 101 denotes an adsorption means composed of a plurality of magnetic substances and magnets which are attached to the fixed hood 71 on the plane abutting on the opening/closing hood 72. Reference numeral 102 denotes a magnetic substance attached to the adsorption means 101 at a position opposite to the adsorption means 101.

Since the sealing ring 10 is attached to the fixed hood 71, when the opening/closing is closed, it is brought into intimate contact with the semi-sphere 10*a* in a crushed state as shown by a phantom line. Therefore, the water vapor will not leak externally from the hood D. In this state, since the magnet is adsorbed to the adsorption means 101 including the magnet, the intimate contact state between the fixed hood 71 and the opening/closing hood 72 is maintained.

Additionally, in the embodiment described above, the sealing ring 10 and the adsorption means 101 are attached to the fixed hood 71, but may be attached to the opening/closing hood 72. In this case, it is of course that the magnetic substance 102 is attached to the fixed hood 71.

Aspect II

In the hair dressing device explained with reference to FIGS. 1 to 7, after the hair has been dressed by the water vapor, the drying of the hair is promoted the air blow by the blower 4. However, when the water vapor is supplied into the hood D through the flexible pipe 31, the water vapor may invade the flexible pipe 41 connected to the blower 4 so that the flexible pipe 41 rusts.

Figure 17:
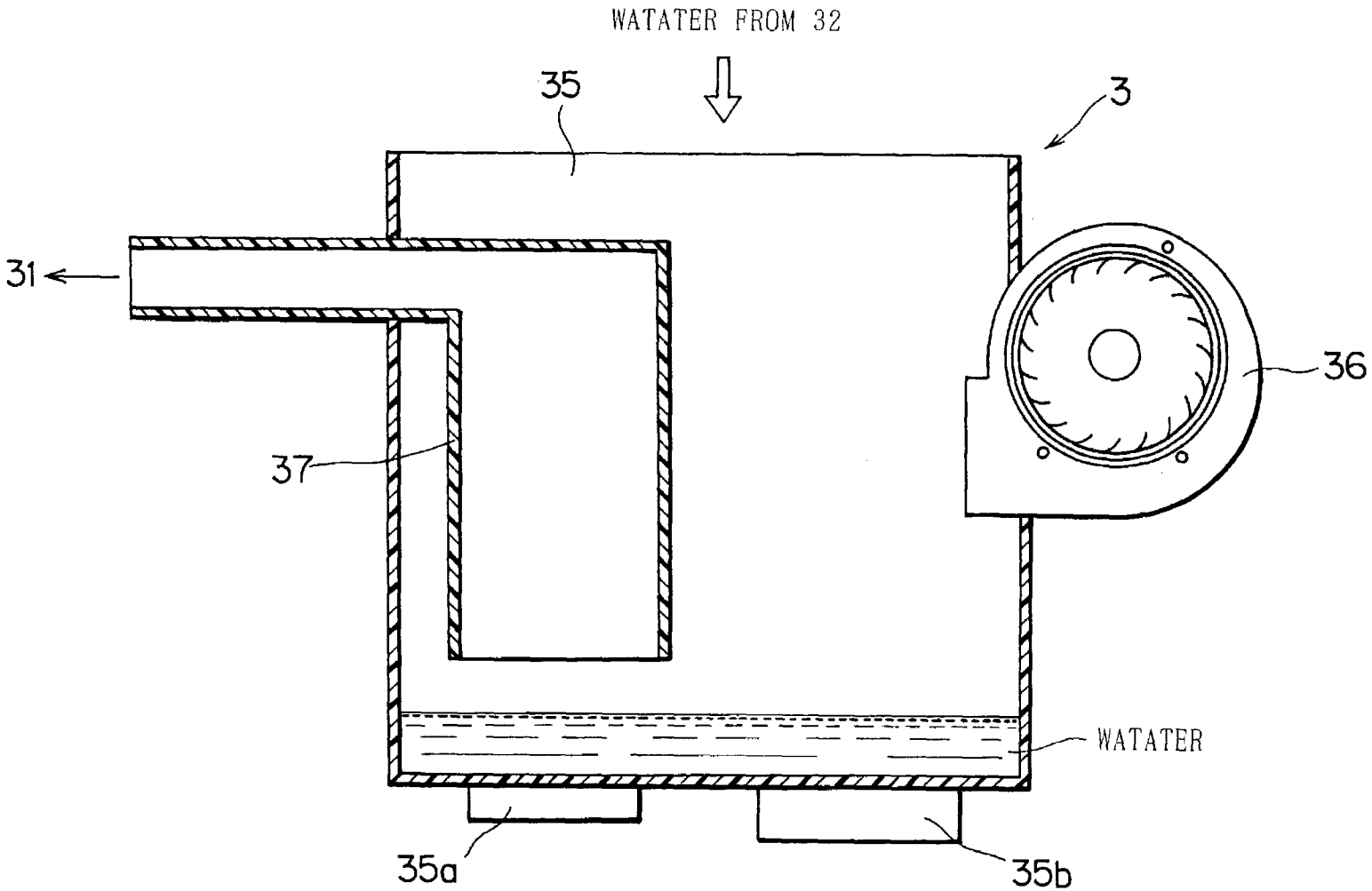
FIG. 17 is a view for explaining the principle of a water vapor generator.

In order to obviate such inconvenience, in accordance with this invention, the water vapor generator having such a configuration as shown in FIGS. 17 to 20 is provided. Incidentally, FIG. 17 shows an example of the water vapor generator 3. As seen from FIG. 1, the water vapor generator 3 is arranged below the water supply tank 32, and the water drops form the water supply tank 32 are supplied into a vessel 35 of the water vapor generator 3.

An ultrasonic oscillator 35*a* and heater 35*b* are attached to the back of the vessel 35. The water drops are trapped in the vessel 35 and fall into a mist state by the ultrasonic oscillator 35*a*. Water vapor is generated by the heater 35*b*. By a fan 36, the mist and water vapor are transferred into the flexible pipe 31 in a high pressure state through a blower tube 37 and into the hood D. The water vapor discharged from the tip of the flexible pipe 31, which is in the high pressure state, will invade the flexible pipe 41 on the side of the blower 4.

Figure 18:
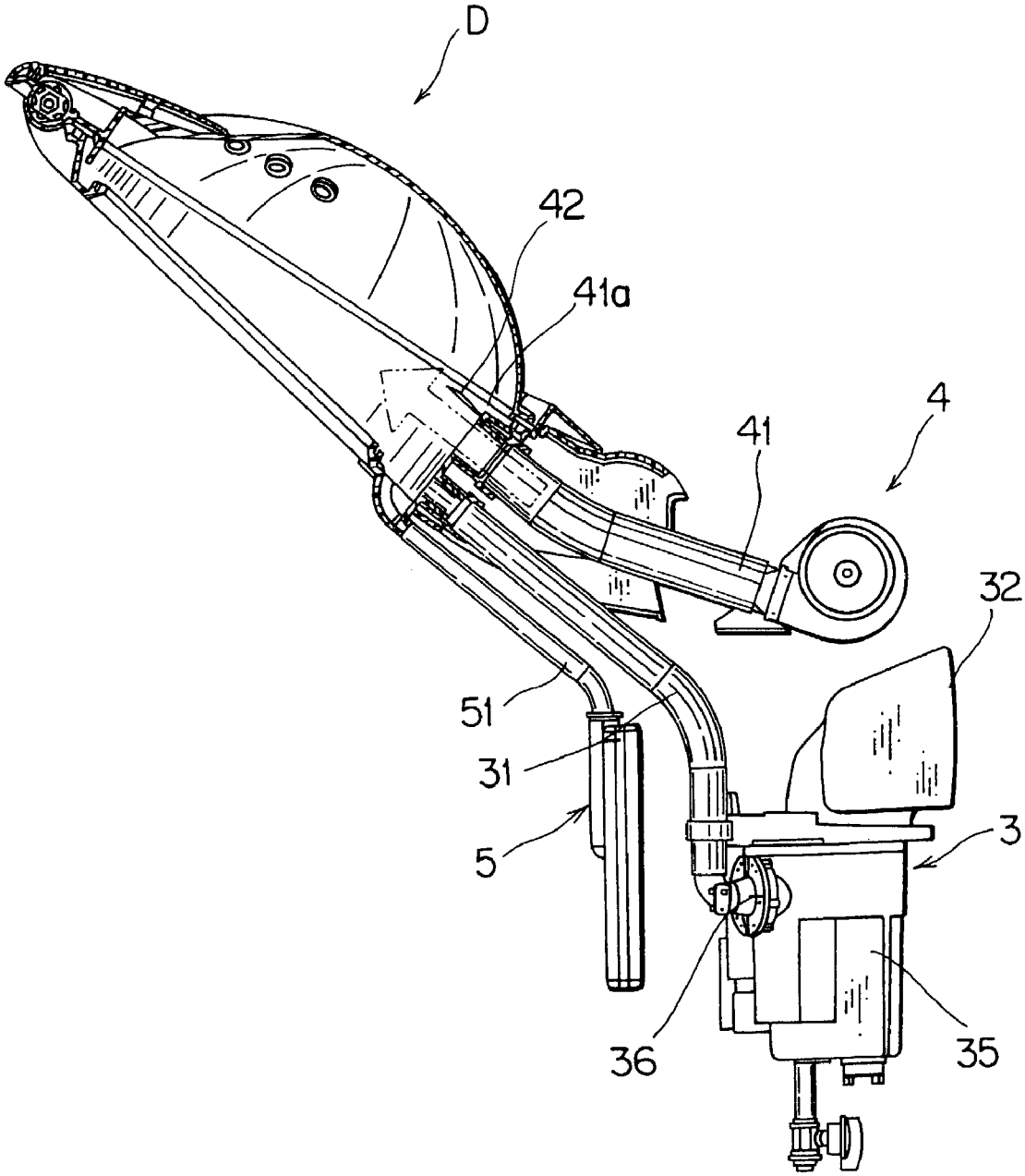
FIG. 18 is a sectional view of the hair dressing device while a blower operates in a first embodiment of the device for preventing water vapor from invading the blower.
Figure 19:
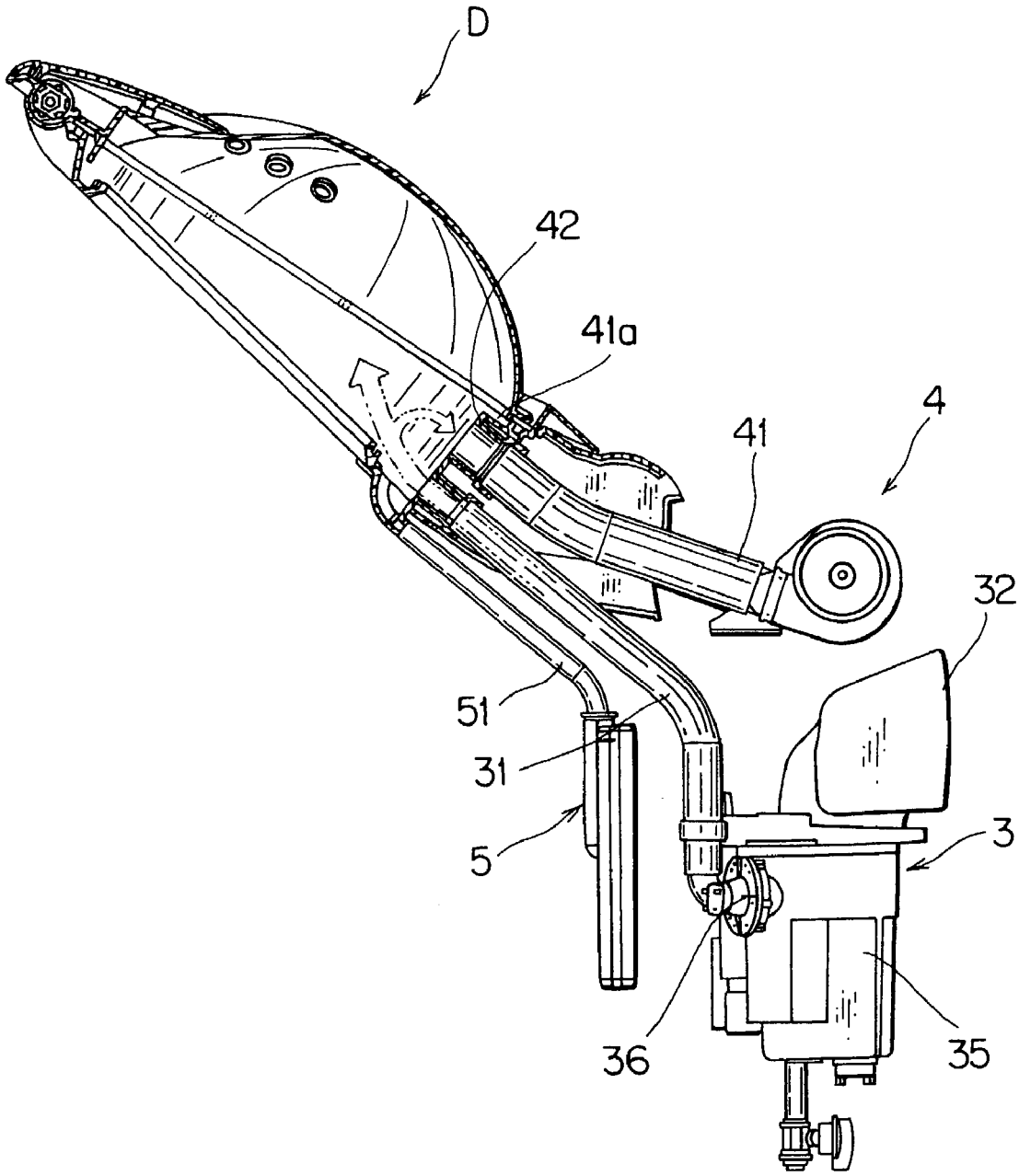
FIG. 19 is a sectional view of the hair dressing device while a water vapor generator operates in the above device.

As seen from FIGS. 17 and 18, a cover 42 is attached to a tip 41*a* of an opening of the flexible pipe 41, which extends into the hood D, so that the cover 42 is swingably pivoted on the upper end of the opening tip 41*a*. The cover 42 serves to close the opening in a closed state. The cover 42 swings to open the opening tip 41*a* according to a wind pressure from the blower 4.

Thus, in the state where water vapor is being supplied into the hood D, the cover 42 is closing the opening tip 41*a* owing to its own weight and the pressure of supplying the water vapor into the hood D. This prevents the blower from rusting owing to the water vapor. Further, when the generation of the water vapor is stopped and the air blow from the air blower is done, the cover swings upwards by the wind pressure so that the opening tip 41*a* is opened. Thus, the hair is dried by the wind from the blower 4.

Figure 20:
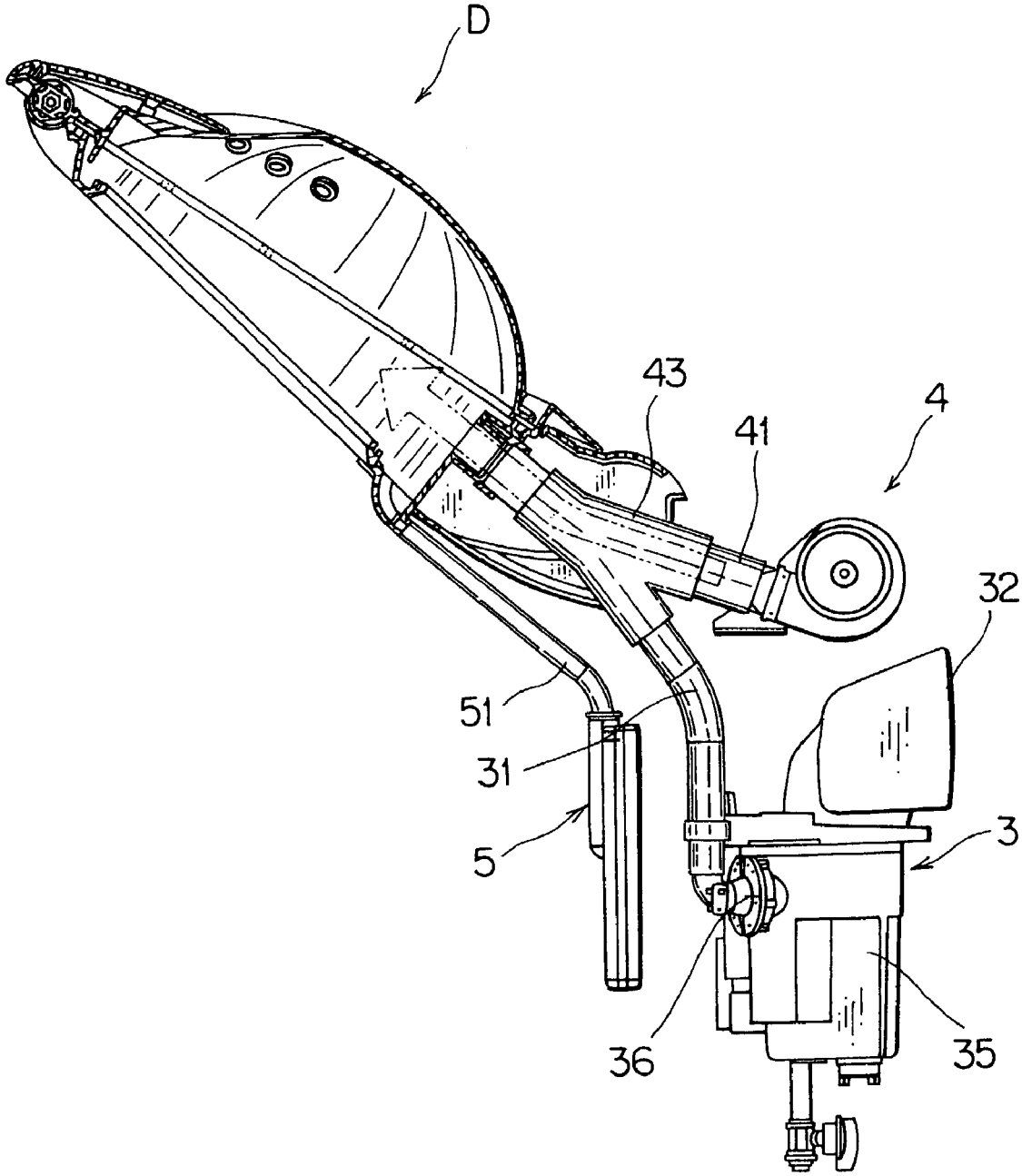
FIG. 20 is a sectional view of the hair dressing device while a blower operates in a second embodiment of the device for preventing water vapor from invading the blower.
Figure 21:
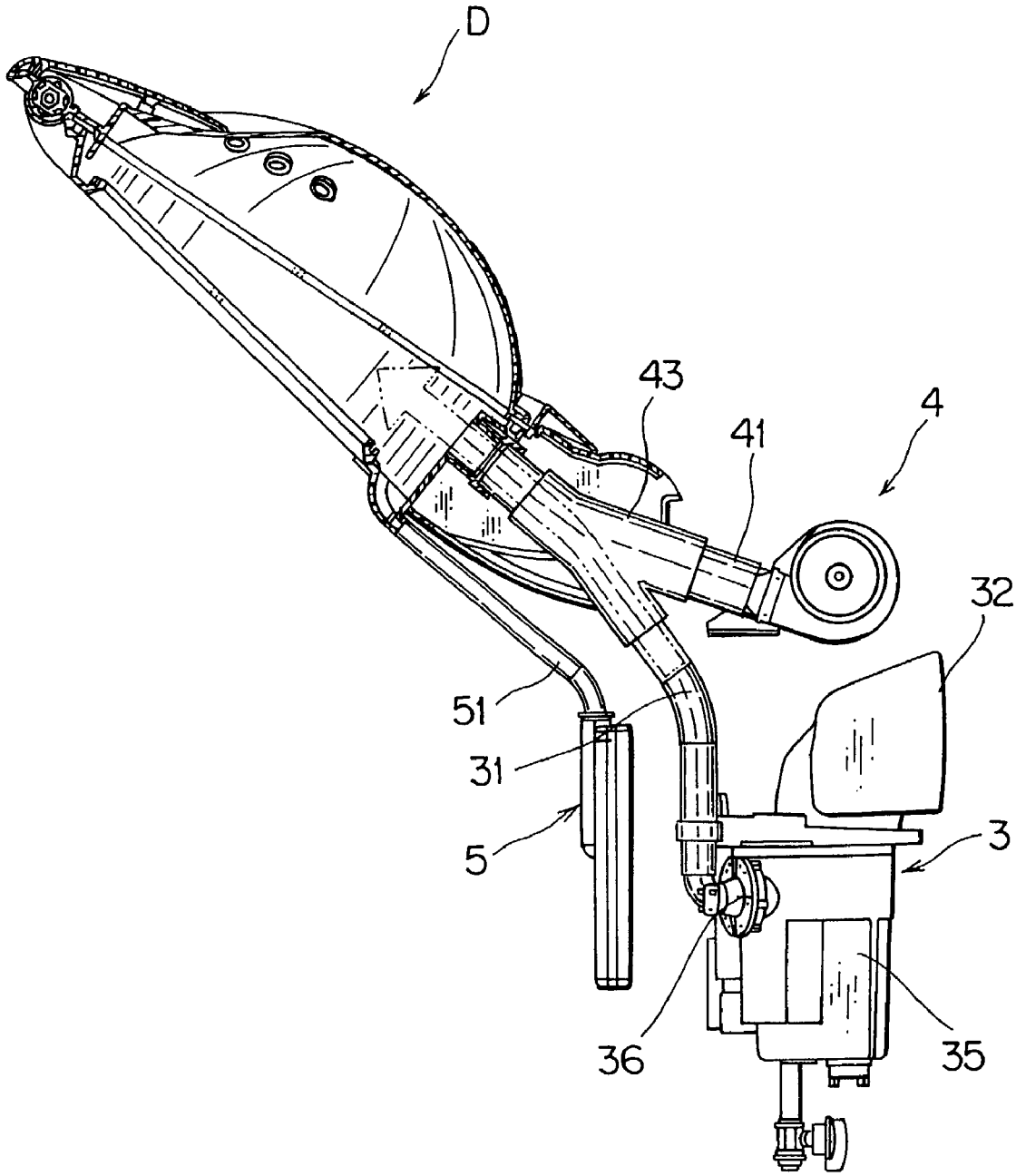
FIG. 21 is a sectional view of the hair dressing device while a water vapor generator operates in the above device.

FIGS. 20 and 21 show another embodiment of a device for preventing invasion of water vapor in a blower. This embodiment is provided with a two-way pipe 43. The separating side thereof outside the hood D is connected to the flexible pipe 31 connected to the water vapor generator 3 and the flexible pipe 41 connected to the blower 4. The common side thereof is connected to the inlet side of the hood D. In FIGS. 20 and 21, like reference numerals refer to like elements in FIGS. 18 and 19.

In such a configuration, the water vapor generated from the water vapor generator 3 is supplied into the hood D through the flexible pipe 31 and the two-way pipe 43. In this case, when the water vapor passes through the two-way pipe 43, the inside of the flexible pipe 41 falls into a negative pressure state according to the flowing speed of the water vapor so that air is pulled from the side of the blower 4 to the flowing side of the water vapor. Thus, the water vapor will not invade the blower 4 so that the blower will not rust owing to the water vapor.

Where the blower 4 is being driven to make wind for drying while the generation of water vapor is stopped, the wind from the blower 4 will not invade the water vapor generator 3 by the same function as described above so that the hot water stored in the vessel 35 is not cooled.

Aspect III

In accordance with this invention, there is provided a hair dressing device equipped with an improved drain tank.

Figure 24:
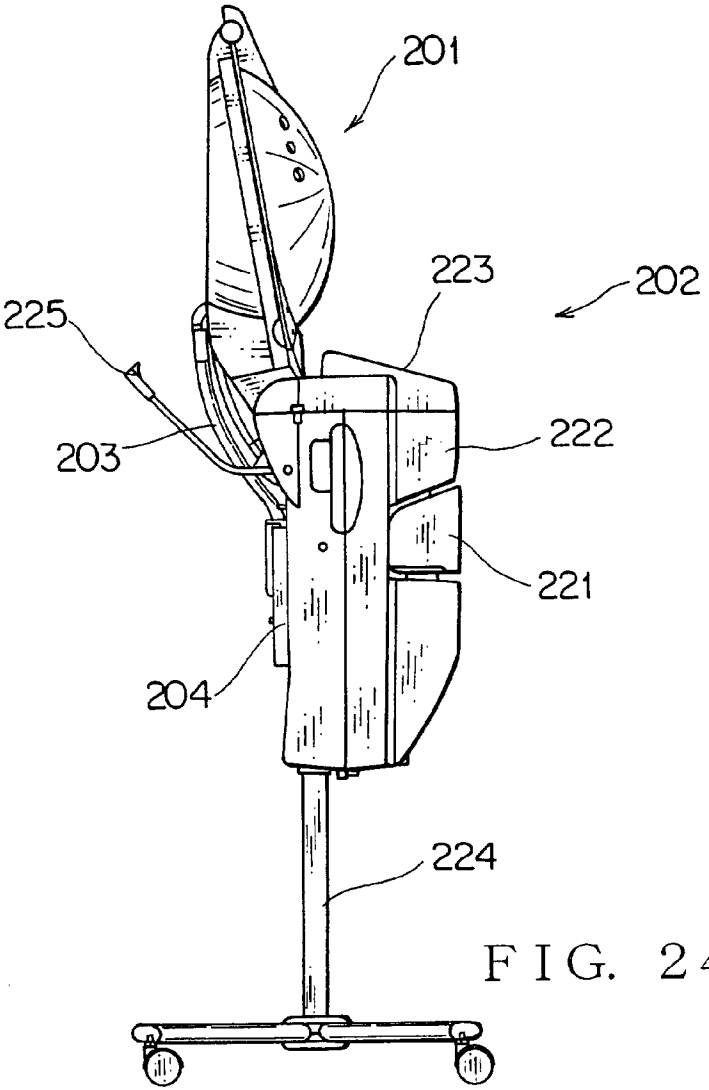
FIG. 24 is a hair dressing device according to this invention in a state where a hood is opened.
Figure 22:
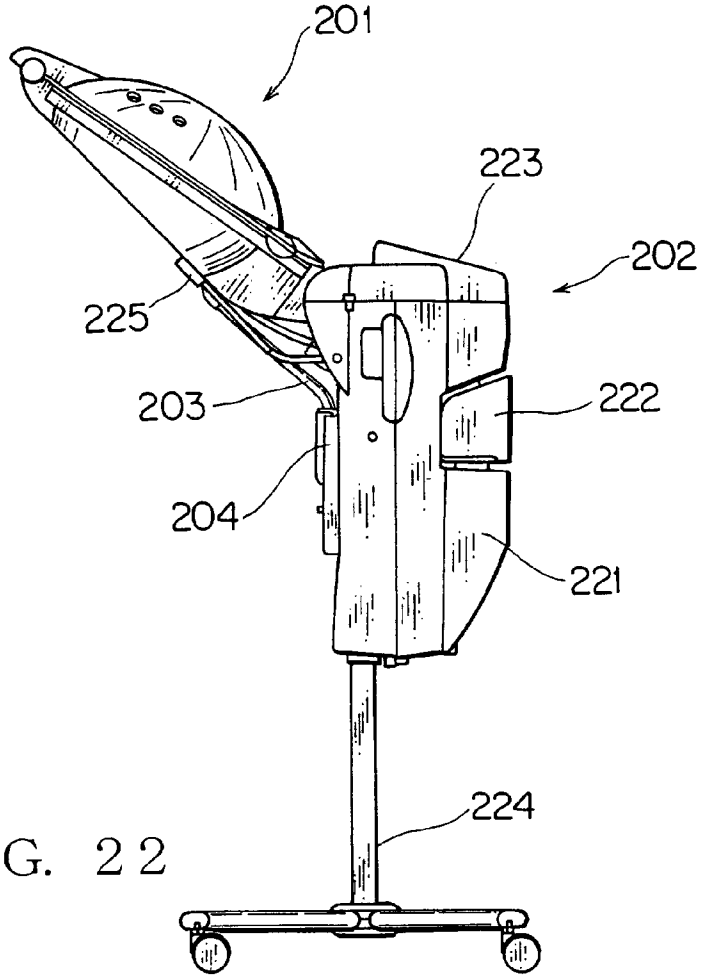
FIG. 22 is a hair dressing device according to this invention in a state where a hood is closed.

In FIGS. 22 and 24, reference numeral 201 denotes a hood, and 202 denotes a device body to which the hood 201 is attached so that the hood 201 can be opened/closed at a closed state (operated state) (FIG. 22) and opened state (non-operated state) (FIG. 24). The device body 202 includes a water vapor generator 221, a tank 222 and an operating panel 223. Reference numeral 224 denotes a caster and reference numeral 225 denotes a neck receiver which is kept in contact with a subject's neck to fix the position of a subject's head.

Figure 26:
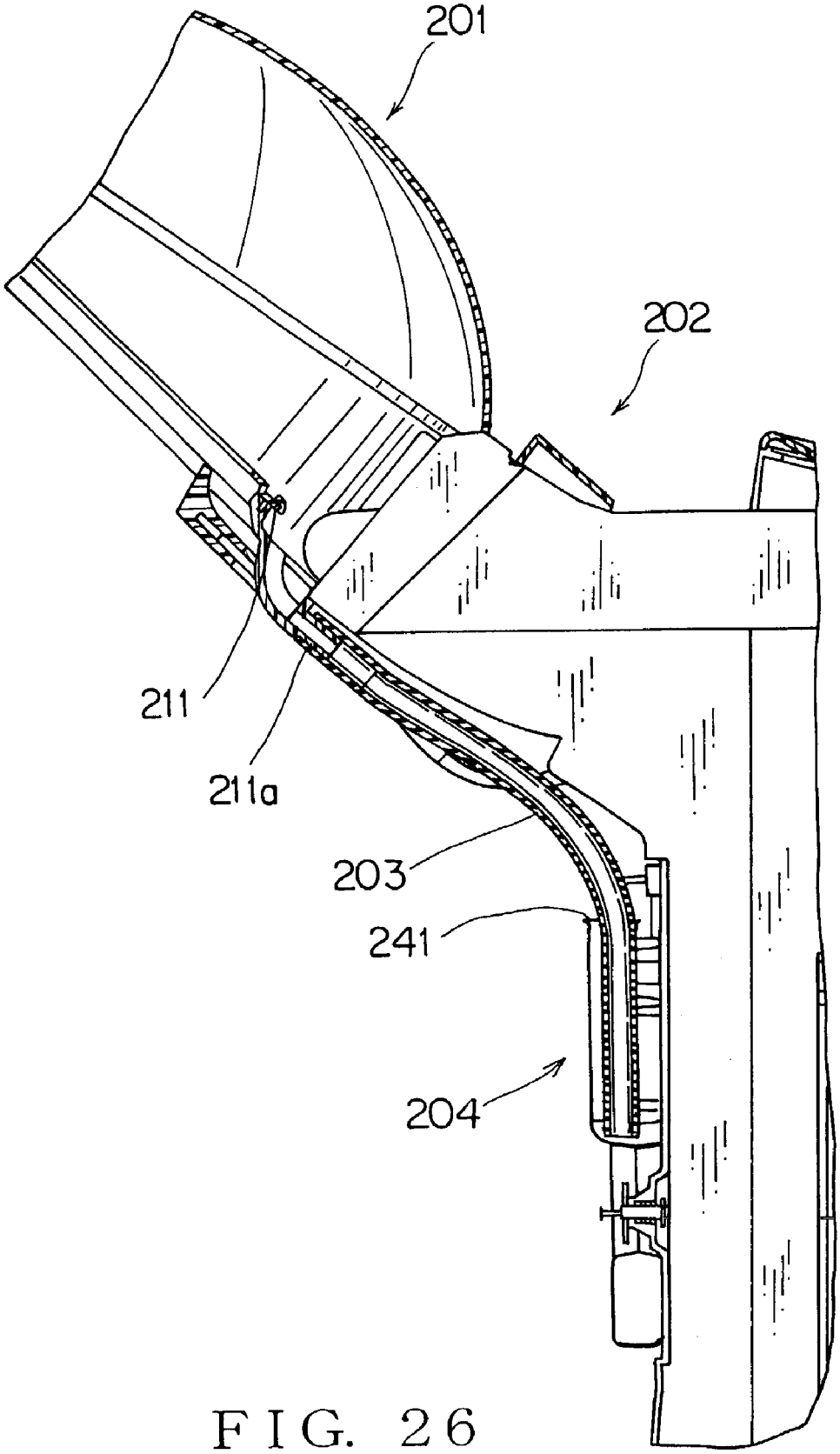
FIG. 26 is a partially-exploded enlarged side view a hair dressing device according to this invention.

FIG. 26 shows a partially sectional view of the hood 201. As seen from FIG. 26, a water path 211 is formed on the inner periphery of the hood 201. The water path 211 serves to receive the water drops which are deposited on and flow along the inner wall of the hood. The outlet 211*a* of the water path 211 is fixedly connected to one end of a flexible pipe 203. The other end of the flexible pipe 203 is slidably inserted into the inlet 241 of a drain tank 204 which is removably attached to an outer wall of the device body 202.

Figure 23:
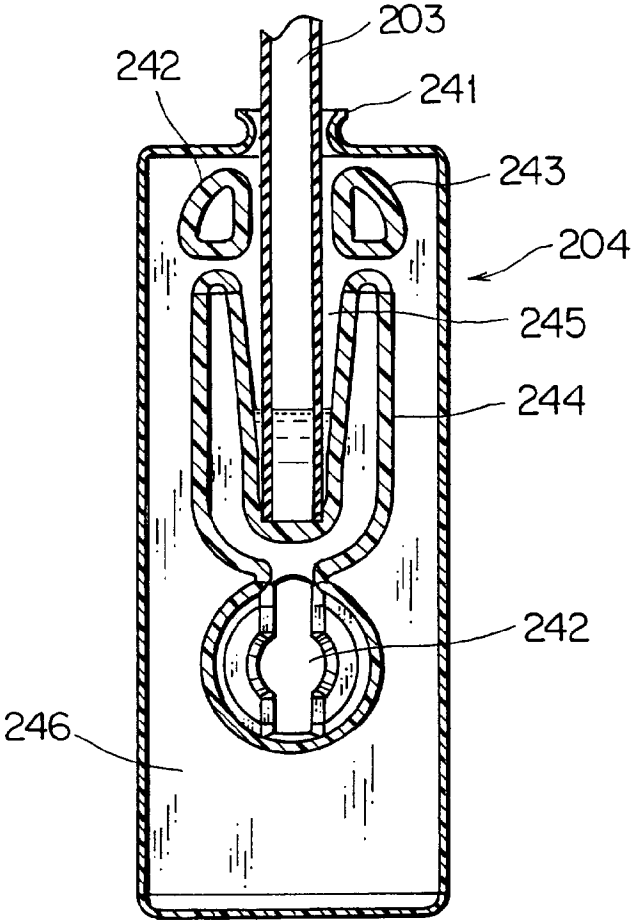
FIG. 23 is a sectional view of a drain tank in the above state.
Figure 25:
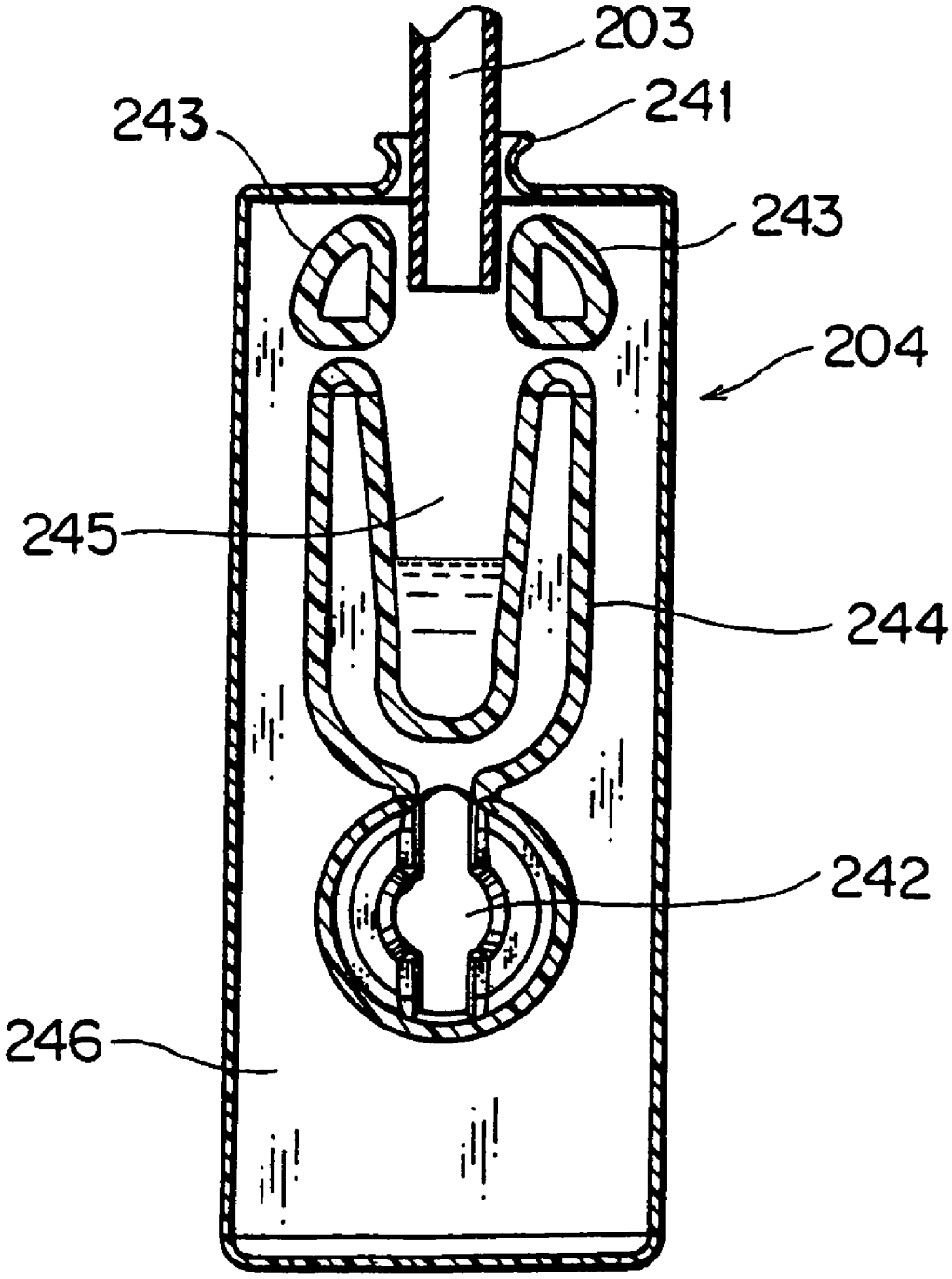
FIG. 25 is a sectional view of a drain tank in the above state.

Now referring to FIGS. 23 and 25, a detailed explanation will be given of the structure of the drain tank 204.

The drain tank 204 is a hollow rectangular body made of synthetic resin. The drain tank 204 is provided with the above inlet 241 at the upper position and holes 242 which are employed to attach the drain tank 204 to the outer wall of the device body 202.

At the upper position within the drain tank 204, a pair of guide portions 243 are formed at the positions the distance between which is larger than the diameter of the flexible pipe 203. Below the guide portions 243, a first trapping portion 245 formed by a U-shape partition wall 244. The U-shape partition wall 244 is extended to form the hole 242. A space below the first trapping portion 45 constitutes a second trapping portion 246.

An explanation will be given of the operation of the drain tank 204. In the state where the hood 201 is put on a subject's head as shown in FIG. 1, the flexible pipe 203 is pushed out downwards to be inserted into the drain tank 204 so that the lower end of the flexible pipe 203 reach the lower end of the first trapping portion 245 of the drain tank 204.

In this state, when the water drops flow out from the outlet 211*a* through the water path 211 as a result that the water vapor is supplied into the hood 201, the water drops flow into the first trapping portion 245 and the lower end of the flexible pipe 203 sinks in the water trapped in the first trapping portion 245.

In this state, when the atmospheric pressure within the hood 203 increases to a prescribed level owing to supply of the water vapor into the hood, the water vapor containing the odor of the medicine solution applied to the hair of the subject as well as the water drops enter the drain tank 204. In this case, since the odor as well as the water vapor is supplied into the trapped water, the odor will not leak out externally.

Therefore, there does not occur a situation where the water drops leak out externally and the water drops are put on the exterior component such as an exterior cover so that the exterior component is soiled. The unpleasant feeling due to the odor is not also given to persons around the hair dressing device. Upon completion of the hair dressing, the hood 201 is rotated counterclockwise as shown in FIG. 24 so that the hood 201 leaves the subject's head. In this case, the flexible pipe 203 is pulled out upwards while it is guided by a guiding portion 243. In both cases where the hood 201 is changed from the closed state into the opened state and vice versa, the flexible pipe 203 will not be bent and deterioration of the flexible pipe 203 can be prevented.

When the first trapping portion 245 is filled with the water, the water overflows from the upper end of a partition wall 244 to flow into the second trapping portion 246. When the second trapping portion 246 is also filled with water, the flexible pipe 203 is pulled out from the inlet 241. By removing the holes 242 from the exterior wall of the device body, the whole water within the drain tank 204 can be drained.

Incidentally, the contents of Japanese Patent Appln. Nos. 2002-165, 2002-166 and 2002-167 are hereby incorporated by reference.

What is claimed is:

1. A hair dressing device equipped with a hood, the hood comprising:

a fixed hood and an opening and closing hood provided over said fixed hood, the opening and closing hood being opened and closed with respect to the fixed hood to expose a head of a subject, wherein said opening and closing hood is hinged to a front side of said fixed hood, and said fixed hood is vertically rotatably attached to a device body which incorporates a water vapor generator necessary for hair dressing, and when said fixed hood is opened beyond a prescribed angle from said device body, said fixed hood is opened by an urging force of rotating said fixed hood upward from said device body, and when said fixed hood is closed to said prescribed angle or lower, weight of said opening and closing hood and said fixed hood overcome said urging force so that said fixed hood is closed.

2. The hair dressing device according to claim 1, wherein said opening and closing hood is urged in its opening direction by a spring at a rotating fulcrum, and is adapted lockable in a closed state at the side of the fixed hood.

3. The hair dressing device according to claim 1, wherein said fixed hood is attached to a vertical movement tube in slidable contact with a support post, the hair dressing device further comprising:

a device body incorporating said vertical movement tube;

a water vapor generator incorporated also in said device body for supplying water vapor into said hood, said water vapor generator being fixed to said vertical movement tube; and an operating portion for controlling said water vapor generator, said operating portion being formed on the upper surface of said device body and being located at a rearward position on a center line of said hood and rearward aslant.

4. The hair dressing device according to claim 1, wherein said fixed hood is attached to a vertical movement tube in slidable contact with a support post, the hair dressing device further comprising:

a device body incorporating said vertical movement tube;

a water vapor generator incorporated also in said device body for supplying water vapor into said hood, said water vapor generator being attached to said vertical movement tube; and a water supply tank for supplying water to said water vapor generator, which is incorporated in said device body and adapted to be detachable aslant behind the vertical movement tube.

5. A hair dressing device comprising:

a hood configured to be placed on a head of a subject when performing hair dressing with water vapor;

a water vapor generator for supplying said water vapor into said hood through a first pipe; and a blower for supplying wind for cooling through a second pipe after performing hair dressing of the head of the subject, wherein said hood includes a fixed hood and an opening and closing hood provided over said fixed hood, the opening and closing hood being opened and closed with respect to the fixed hood to expose a head of a subject, the opening and closing hood is hinged to a front side of the fixed hood, and said fixed hood is vertically rotatably attached to a device body which incorporates a water vapor generator necessary for hair dressing, and when said fixed hood is opened beyond a prescribed angle from said device body, said fixed hood is opened by an urging force of rotating said fixed hood upward from said device body, and when said fixed hood is closed to said prescribed angle or lower, weight of said opening and closing hood and said fixed hood overcome said urging force so that said fixed hood is closed.

6. The hair dressing device according to claim 5, wherein the first and second pipes are connected to an inner periphery of the hood, said dressing device further comprising:

a diffusing plate attached to the inner periphery of said hood at a position corresponding to where the first and second pipes connect to the inner periphery of said hood, said diffusing plate diffusing the water vapor and wind supplied from the water vapor generator and blower into the hood.

7. The hair dressing device according to claim 5, wherein a water path is formed in an opening of said hood to receive water drops from an inner periphery of hood, said water path has a hole made at the lowest position when said hood is opened, and a drain tank is removably attached to said hole.

8. A hair dressing device comprising:

a hood configured to be placed on a head of a subject which is to be hair-dressed by water vapor;

a water vapor generator for supplying said water vapor into said hood through a first pipe;

a blower for supplying wind for cooling through a second pipe after the head of the subject has been hair-dressed; and a cover attached to said second pipe, said cover closing while the wind is not supplied and swings to open because of wind pressure while the wind is supplied into the hood.

9. A hair dressing device comprising:

a hood configured to be placed on a head of a subject which is hair-dressed by water vapor supply, said hood being attached to a device body post;

a water vapor generator incorporated in said device body post for supplying water vapor into said hood;

a water supply tank for supplying water to said water vapor generator, which is attached to said device body post;

a drain valve for draining remaining water from the bottom of said water supply tank; and a drain cup located below said drain valve, which is detachable from said device body post.

* * * * *

US007028348C1

(12) EX PARTE REEXAMINATION CERTIFICATE (6126th)

United States Patent
Tadaka et al.

(10) Number: US 7,028,348 C1
(45) Certificate Issued: Feb. 19, 2008

(54) HAIR DRESSING DEVICE EQUIPPED WITH HOOD

(75) Inventors: Tomoaki Tadaka, Osaka (JP); Keiji Ito, Osaka (JP); Norimasa Okuzaki, Osaka (JP); Hajime Mizutani, Osaka (JP)

(73) Assignee: Takara Belmont Corporation, Osaka (JP)

Reexamination Request:
No. 90/008,091, May 22, 2006

Reexamination Certificate for:

| | |
|---|---|
| Patent No.: | **7,028,348** |
| Issued: | **Apr. 18, 2006** |
| Appl. No.: | **10/390,025** |
| Filed: | **Mar. 18, 2003** |

(51) Int. Cl.
*A45D 19/00* (2006.01)

(52) U.S. Cl. ..... 4/516; 4/518; 132/272

(58) Field of Classification Search ..... 137/271, 137/272; 4/515–520, 522, 537, 521
See application file for complete search history.

(56) References Cited

U.S. PATENT DOCUMENTS

| | | | |
|---|---|---|---|
| 4,352,248 | A | 10/1982 | Kobayashi |
| 4,377,174 | A | 3/1983 | Muraji et al. |

*Primary Examiner*—Matthew C. Graham

(57) ABSTRACT

In order to dress a subject's hair using the two first and second kinds of medicine solutions, a hood must be once taken off. Therefore, in order to apply the second medicine solution, the position of the hood must be adjusted so that the head is centrally located at the hood. This adjustment is troublesome for both the operator and subject. In order to obviate such inconvenience, a hair dressing device equipped with a hood D includes a fixed hood 71 and an opening/closing hood 72 into which said hood is divided, said opening/closing hood being openably attached to said fixed hood. In this case, said opening/closing hood 72 is opened/closed so that said fixed hood 71 is opened from above.

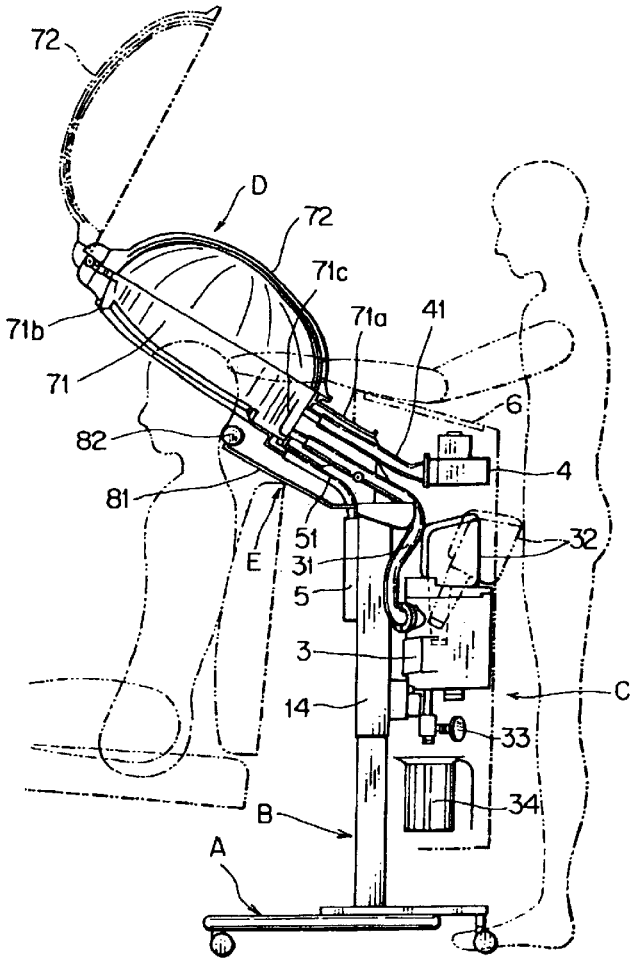

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7 is confirmed.

Claims 8 and 9 are determined to be patentable as amended.

8. [A] *The* hair dressing device *according to claim 5, further* comprising[:

a hood configured to be placed on a head of a subject which is to be hair-dressed by water vapor;

a water vapor generator for supplying said water vapor into said hood through a first pipe;

a blower for supplying wind for cooling through a second pipe after the head of the subject has been hair-dressed; and]

a cover attached to said second pipe, said cover closing while the wind is not supplied and swings to open because of wind pressure while the wind is supplied into the hood.

9. [A] *The* hair dressing device *according to claim 5, further* comprising:

[a hood configured to be placed on a head of a subject which is hair-dressed by water vapor supply,] *a device body post, wherein* said hood [being] *is* attached to [a] *the* device body post[;] *and said*

[a] water vapor generator *is* incorporated in said device body post for supplying water vapor into said hood;

a water supply tank for supplying water to said water vapor generator, which is attached to said device body post;

a drain valve for draining remaining water from the bottom of said water supply tank; and a drain cup located below said drain valve, which is detachable from said device body post.

* * * * *